US006759807B2

(12) United States Patent
Wåhlin

(10) Patent No.: US 6,759,807 B2
(45) Date of Patent: Jul. 6, 2004

(54) MULTI-GRID ION BEAM SOURCE FOR GENERATING A HIGHLY COLLIMATED ION BEAM

(75) Inventor: Erik Karl Kristian Wåhlin, Longmont, CO (US)

(73) Assignee: Veeco Instruments, Inc., Woodbury, NY (US)

( * ) Notice: Subject to any disclaimer, the term of this patent is extended or adjusted under 35 U.S.C. 154(b) by 69 days.

(21) Appl. No.: 10/117,004

(22) Filed: Apr. 4, 2002

(65) Prior Publication Data

US 2003/0193294 A1 Oct. 16, 2003

(51) Int. Cl.[7] ..... H05H 1/02

(52) U.S. Cl. ..... 315/111.21; 315/111.31; 313/361.1; 313/361.2

(58) Field of Search ..... 313/361.1, 361.2; 315/111.21, 111.31

(56) References Cited

U.S. PATENT DOCUMENTS

| | | | | |
|---|---|---|---|---|
| 3,849,656 A | | 11/1974 | Wallington | |
| 3,884,793 A | | 5/1975 | Penfold et al. | |
| 3,995,187 A | | 11/1976 | Penfold et al. | |
| 4,030,996 A | | 6/1977 | Penfold et al. | |
| 4,031,424 A | | 6/1977 | Penfold et al. | |
| 4,737,688 A | * | 4/1988 | Collins et al. | 315/111.21 |
| 5,019,712 A | | 5/1991 | Knauer | |
| 5,036,252 A | | 7/1991 | Lob | |
| 5,069,770 A | | 12/1991 | Glocker | |
| 5,187,580 A | | 2/1993 | Porter, Jr. et al. | |
| 5,189,303 A | | 2/1993 | Tanjyo et al. | |
| 5,198,718 A | | 3/1993 | Davis et al. | |
| 5,365,070 A | | 11/1994 | Anderson et al. | |
| 5,532,483 A | | 7/1996 | Ose et al. | |
| 5,559,337 A | | 9/1996 | Ito et al. | |
| 6,063,436 A | | 5/2000 | Pavell et al. | |
| 6,132,576 A | | 10/2000 | Pearson | |
| 6,346,768 B1 | | 2/2002 | Proudfoot | 313/359.1 |

FOREIGN PATENT DOCUMENTS

WO WO 98/18150 4/1998

OTHER PUBLICATIONS

"Radio frequency linear ion beam source with 6 cmx66 cm beam," D. Siegfried, B. Buchholtz, D. Burtner, and W. Foster, Review of Scientific Instruments, vol. 71, No. 2, Fev. 2000.

"Ion Beam Divergence Characteristics of Two– Grid Accelerator Systems," G. Aston, H.R. Kaufman, and P.J. Wilbur, AIAA Journal, vol. 16, No. 5, May 1978, pp. 516–524.

"Ion Beam Divergence Characteristics of Three– Grid Accelerator Systems," G. Aston and H.R. Kaufman, AIAA/DGLR 13th International Electric Propulsion Conference, San Diego, California, Apr. 25–27, 1978.

(List continued on next page.)

*Primary Examiner*—David Vu
(74) *Attorney, Agent, or Firm*—Lee & Hayes, PLLC

(57) ABSTRACT

A multi-grid ion beam source has an extraction grid, an acceleration grid, a focus grid, and a shield grid to produce a highly collimated ion beam. A five grid ion beam source is also disclosed having two shield grids. The extraction grid has a high positive potential and covers a plasma chamber containing plasma. The acceleration grid has a non-positive potential. The focus grid is positioned between the acceleration grid and the shield grid. The combination of the extraction grid and the acceleration grid extracts ions from the plasma. The focus grid acts to change momentum of the ions exiting the acceleration grid, focusing the ions into a more collimated ion beam than previous approaches. In one embodiment, the focus grid has a large positive potential. In another embodiment, the focus grid has a large negative potential.

35 Claims, 22 Drawing Sheets

OTHER PUBLICATIONS

"Ion Beamlet Divergence Characteristics of Two– Grid Multiple– Hole Ion– Accelerator Systems," Y. H ayakawa and S. Kitamura, 33rd AIAA/ASME/SAE/ASEE Joint Propulsion Conference & Exhibit, Jul. 6–9, 1997, Seattle, Washington.

"The Ion– Optics of a Two– Grid Electron– Bombardment Thruster," G. Aston and H.R. Kaufman, AIAA International Electric Propulsion Conference, Key Biscayne, Florida, Nov. 14–17,. 1976.

Klemperer, O,: "Electron Optics"; Cambridge University Press, Cambridge England, 1953 pp. 82–103.

* cited by examiner

MULTI-GRID ION BEAM SOURCE FOR GENERATING A HIGHLY COLLIMATED ION BEAM

FIELD OF THE INVENTION

This invention generally relates to ion beam sources, and, in particular, to generating highly collimated ion beamlets by utilizing a set of grid optics in an ion beam source.

BACKGROUND OF THE INVENTION

Ion beams come in many varieties and have many industrial applications. For example, a collimated low-power ion beam may be employed to align inorganic materials in a liquid crystal display. Alternatively, a collimated high-power ion beam may be employed to ion etch a surface or propel a vehicle in space. A highly collimated ion beam, which has minimum off-axis velocity components, is generally desirable in many broad beam ion source applications. Other applications of collimated ion beams include without limitation ion milling and aligning superconducting $YBa_2Cu_3O_7$ crystals as they grow using Ion Beam Assisted Deposition techniques to increase the current carrying capability of High Temperature Superconducting tapes.

An "ion" is a charged particle, referring to any atom or molecule having an unbalanced electrical charge, which is a result of having lost or gained one or more electrons. A gas phase collection of ionized atoms, molecules, and/or electrons is referred to as "plasma". Generally, plasma states can be induced in gases, such as neon, argon, etc., by applying high-energy radio frequency (RF) fields or a direct current (DC) voltage to the gaseous matter. The radio frequency fields remove electrons from the particles, giving the particles a positive charge. Using electric fields, the ions can then be extracted from the plasma and propelled to a target in an ion beam.

One technique for extracting ions from the plasma involves placing an electrical field near the plasma. A simple example of an ion beam provides plasma in a plasma chamber with two electrified grids positioned at an opening of the plasma chamber. Each grid has an array of apertures to allow ions to travel through the grid during operation. Typically, the apertures of one grid are closely aligned with apertures of the other grid. The first electrified grid (i.e., the grid closest to the plasma) is called an "extraction grid" or a "screen grid", and has a high positive electrical potential (e.g., 1000 Volts). The second grid, called an "acceleration grid", is spaced closely to the first grid and has a negative potential (e.g., –400 Volts).

For 2-grid systems, ion beam divergence is strongly dependent upon normalized perveance per aperture, the extraction-grid-to-acceleration-grid spacing, the aperture size, and the net-to-total-accelerating-potential ratio. Perveance is a normalized measure of the current of ions extracted through each aperture. Adjustments to the spacing and aperture hole sizes can reduce the net ions impinging upon the grids and decrease the angular divergence of the ion beam. It has been shown that the best-case divergence angle for a two-grid ion source is 10 degrees and can be as large as 30 degrees. See G. Aston et al, "Ion Beam Divergence Characteristics of Two-Grid Accelerator Systems", AIAA Journal, Vol. 16, No. 5, May 1978, pp. 516–524; G. Aston et al., "The Ion-Optics of a Two-Grid Electron Bombardment Thruster," AIAA Paper 76–1029, Key Biscayne, Fla., 1976; Y. Hayakawa et al., Ion Beamlet Divergence Characteristics of Three-Grid Accelerator Systems," AIAA Paper 97–3195, Seattle, Wash., 1997.

Another technique involves a third grid, called a "shield grid", which is placed the furthest away from the plasma chamber and is typically spaced closely to the acceleration grid. In many applications, an RF excited plasma bridge neutralizer is positioned in the vicinity of the ion beam output and is used to provide electrons for current and space charge neutralization of the ion beam, for example, to reduce inter-ion repulsion within the ion beam. The shield grid is typically charged to a low electrical potential (e.g., 0 Volts). By positioning the shield grid downstream (i.e., away from the plasma source) of the acceleration grid and operating it at a near ground potential, the neutralization plane becomes fixed in close proximity to the shield grid potential. This characteristic allows for flatter equipotential surfaces between the neutralization plane and the acceleration grid apertures as compared to the 2-grid system, resulting in less off axis divergence of the ion beam (e.g., the best case is about 8.2 degrees).

However, some applications require less off-axis divergence. In an attempt to decrease off-axis divergence, one existing technique has introduced a second positive electrical potential acceleration grid between the extraction grid and the negative-potential acceleration grid described previously. See PCT Application PCT/GB97/02923, ION GUN, by Nordiko Ltd., published Apr. 30 1998. The new acceleration grid is intended to provide "gentler" acceleration so as to allow formation of a lower current, more stably collimated beam, which is less susceptible to space charge forces. However, the existing 4-grid optics system requires the new acceleration grid to be contoured (instead of flat), resulting in non-uniform spacing from center-to-edge between the grids in the ion beam source. Moreover, the main result of "gentle" extraction of the ions by the existing 4-grid optics system is low perveance and, therefore, a reduced ion beam current caused by the reduced electrical potential between the extraction grid and the new acceleration grid, which is predicted by Child's Law. See Child, C. D., Physical Review, Vol. 32, 1911, pp. 492–511. No experimental data is available to support the claim of improved collimation in any existing 4-grid optics system and, furthermore, the reduced ion beam current is inadequate for many applications. Accordingly, existing ion beam systems fail to provide adequate collimation and ion beam current for many applications.

SUMMARY OF THE INVENTION

Against this backdrop, the present invention has been developed. The present invention relates to a multi-grid ion beam source having a focus grid positioned between the acceleration grid and the shield grid or between two shield grids. In one embodiment, the focus grid has a large positive potential, resulting in an off-axis divergence of about 1.5 degrees. In another embodiment, the focus grid has a large negative potential, resulting in an off-axis divergence of about 1.4 degrees. The focus grid acts to change momentum of the ions, focusing them into a more collimated ion beam when propelled through a shield grid than previous approaches.

In one embodiment of the present invention, a method of tuning a focus grid potential in an ion beam source is provided. The ion beam source is capable of generating a substantially collimated ion beam that sends ions toward a target along an axis extending between a plasma source and the target. An extraction grid is spaced downstream from the plasma source along the axis and substantially normal to the axis. The extraction grid has a positive electrical extraction potential. An acceleration grid is spaced downstream from the extraction grid along the axis between the extraction grid and the target and substantially normal to the axis. The acceleration grid has a non-positive electrical acceleration potential. A focus grid is spaced downstream from the acceleration grid along and substantially normal to the axis between the acceleration grid and the target to focus the ions exiting the acceleration grid into a substantially collimated ion beam along the axis. The focus grid has an electrical focus potential. A shield grid is spaced downstream from the focus grid along and substantially normal to the axis between the focus grid and the target. The shield grid has an electrical shield potential. The angle of divergence of the ion beam is detected. The electrical focus potential is altered until the detected angle of divergence of the ion beam is minimized.

In another implementation of the present invention, a method of generating a substantially collimated ion beam sending ions toward a target along an axis extending between a plasma source and the target is provided. A positive electrical extraction potential is applied to an extraction grid spaced downstream from the plasma source along the axis and substantially normal to the axis. A non-positive electrical extraction potential is applied to an acceleration grid spaced downstream from the extraction grid along the axis between the extraction grid and the target and substantially normal to the axis. The electrical extraction potential and the electrical acceleration potential operate in combination to extract the ions from the plasma source. An electrical focus potential is applied to a focus grid spaced downstream from the acceleration grid along and substantially normal to the axis between the acceleration grid and the target to focus the ions exiting the acceleration grid by changing momentum of the ions along the axis. An electrical shield potential is applied to a shield grid spaced downstream from the focus grid along and substantially normal to the axis between the focus grid and the target to locate a neutralization plane near the shield grid.

In yet another embodiment of the present invention, an ion beam source for generating a substantially collimated ion beam sending ions toward a target along an axis extending between a plasma source and the target is provided. An extraction grid is spaced downstream from the plasma source along the axis and substantially normal to the axis. The extraction grid has a positive electrical extraction potential. An acceleration grid is spaced downstream from the extraction grid along the axis between the extraction grid and the target and substantially normal to the axis. The acceleration grid has a non-positive electrical acceleration potential, the electrical extraction potential and the electrical acceleration potential operating in combination to extract the ions from the plasma source. A focus grid is spaced downstream from the acceleration grid along and substantially normal to the axis between the acceleration grid and the target to focus the ions exiting the acceleration grid by changing momentum of the ions along the axis. A shield grid is spaced downstream from the focus grid along and substantially normal to the axis between the focus grid and the target to locate a neutralization plane near the shield grid.

These and various other features as well as other advantages, which characterize the present invention, will be apparent from a reading of the following detailed description and a review of the associated drawings.

DETAILED DESCRIPTION

In an embodiment of the present invention, a 4-grid ion beam source generates a highly collimated ion beam. The 4-grid optics system comprises an ordered set of four grids: extraction grid, an acceleration grid, a focus grid, and a shield grid, progressing from the plasma source (e.g., a plasma chamber) toward a target. In one embodiment, the focus grid has high positive potential. In another embodiment, the focus grid has a high negative potential. In other embodiments, 5-grid optics systems are provided, including one embodiment with a negative biased focus grid and another embodiment with a positive biased focus grid. Adding additional grid to the described configurations will not depart from the scope of the present invention.

Figure 1A:
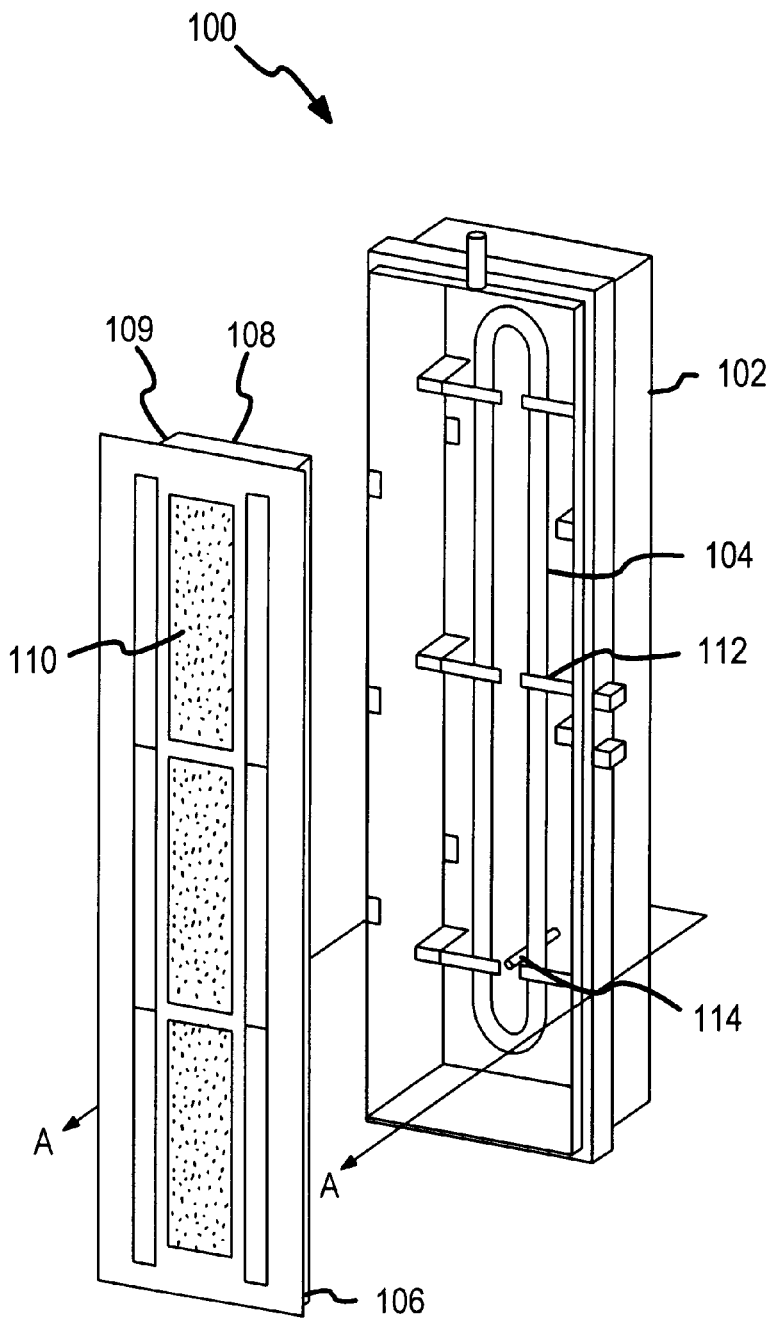
FIG. 1A depicts a generalized three-dimensional view of a rectangular 4-grid ion beam source in an embodiment of the present invention.
Figure 1B:
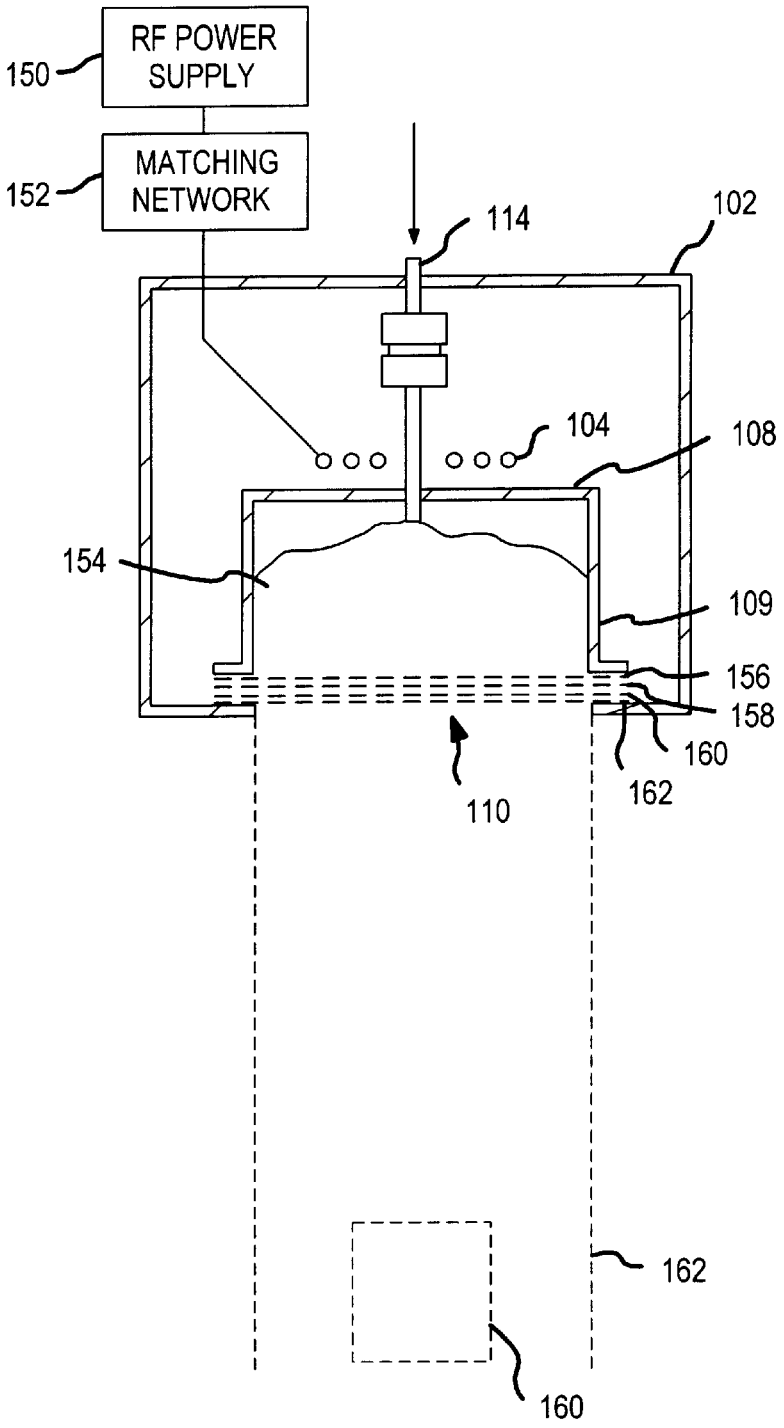
FIG. 1B depicts a cross sectional view of the ion beam source shown in FIG. 1A.

FIG. 1A depicts a generalized three-dimensional, exploded view of a rectangular 4-grid ion beam source 100 in an embodiment of the present invention. In this embodiment, an RF coil is used to generate a plasma discharge. A direct current (DC) plasma discharge can also be employed to generate the plasma in alternative embodiments. FIG. 1B depicts a cross sectional view of the ion beam source 100 shown in FIG. 1A with plasma 154 shown in the plasma discharge chamber 109. During operation, the 4-grid ion beam source is positioned in a high vacuum chamber with a pressure of about $1\times10^{-4}$ torr to $5\times10^{-4}$ torr, although pressures outside of that range may be employed in alternative embodiments. A shroud 102 partially encloses an inductive radio frequency (RF) coil 104 supported by coil insulators (such as 112), and a high voltage isolated gas inlet line 114. The radio frequency (RF) coil 104, which may be an oval spiral or other known coil configuration, is driven at 13.56 MHz using a 1 kilowatt power supply 150 through a capacitive matching network 152.

A grid system 106 attaches to the shroud 102 to fully enclose the RF coil 104 and coil supports 112. The grid system 106 includes an array of four grids 110 (i.e., an extraction grid 156, an acceleration grid 158, a focus grid 160, and a shield grid 162) and a dielectric window 108 to a plasma discharge chamber 109. Each grid comprises a pattern of apertures through its surface to allow ions to pass through the grid. When positioned within the grid system 106 the apertures of each grid are substantially aligned or coaxial with the apertures of each of the other grid, although some variation of alignment may be used to obtain a required beam profile. The set of four substantially aligned apertures through which a collection of ions passes is termed an "aperture set". The apertures themselves may vary in size between individual grids as well as across the surface of a single grid. The thickness of individual grids and the spacings between individual grids may vary to obtain a required beam profile and beam energy level. On one embodiment of the present invention, all of the grids in the 4-grid system 504 are flat. However, in alternative embodiments, one or more of the grids may be "dished" or curved without departing from the present invention.

The gas intake line 114 inserts through the dielectric window 108 into the plasma discharge chamber 109 During operation, a gas, including without limitation argon, oxygen, nitrogen, methane (or other carbon containing gas), xenon, or krypton, is input to the gas intake line 114 and ionized as the gas passes the RF coil 104 As a result, ionized particles of the gas are flushed into the plasma discharge chamber 109 to form plasma 154. The dielectric window 108 is capacitively coupled to the RF coil 104 to sustain the plasma 154 in the plasma discharge chamber 109. The extraction grid 156, the acceleration grid 158 the focus grid 160, and the shield grid 162 extract ions from the plasma discharge chamber 109 and propel the ions through the apertures in the grids 110 toward a target 160 in the form of an ion beam 162.

Figure 2:
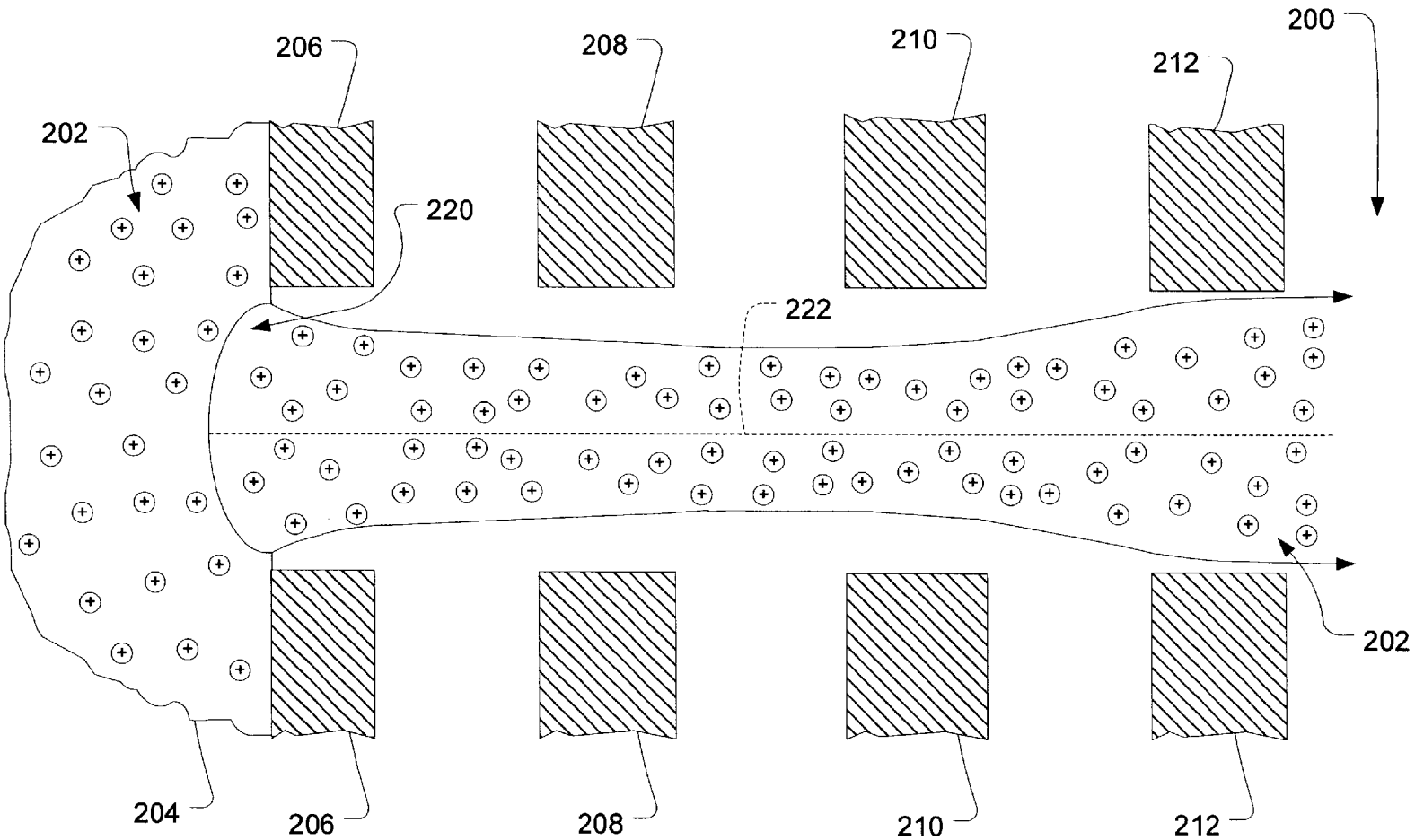
FIG. 2 schematically depicts an ion beamlet being extracted and propelled through an aperture set of a 4-grid ion beam source in an embodiment of the present invention, wherein the focus grid has a high negative potential.

FIG. 2 schematically depicts an ion beamlet being extracted and propelled through an aperture set of a 4-grid ion beam source in an embodiment of the present invention, wherein the focus grid has a high negative potential. A "beamlet" 200 represents a stream of ions extracted and propelled through an aligned aperture set, as show in FIG. 2. The aperture set is represented by gaps between like-numbered grid portions of grids 206, 208, 210, and 212. An array of generally circular apertures is distributed, uniformly or non-uniformly, across the surface of each grid, although apertures may have non-circular shapes in alternative embodiments.

Grids can be made of various materials, depending on the application and operating environment, including molybdenum and pyrolytic graphite. The grids are illustrated as planar, although one or more grids may be dished in alternative embodiments.

Ions 202 are extracted from plasma 204, which is temporarily stored in a low energy plasma discharge chamber, such as shown in FIG. 1B. Under normal operation, the plasma tends to form a concave surface at an extraction point 220. The 4-grid optics system shown in FIG. 2 includes an extraction grid 206 having an extraction grid potential of 900 volts, an acceleration grid 208 having an acceleration grid potential of −150 volts, a focus grid 210 having a focus grid potential of −2500 volts, and a shield grid 212 having a shield grid potential of 0 volts. During operation, positively charged ions 202 are extracted from the plasma discharge chamber at the extraction point 220 and propelled through the aperture set toward a target. The dashed line 222 shows a centerline axis through the aperture set of grid optics illustrated in FIG. 2, wherein the axis between the plasma source and the target representing the direction in which the ion beam travels. Each grid is mounted substantially normal to the axis.

In the illustrated embodiment, the extraction grid 206 has a high positive potential (such as 150 to 2500 volts in various embodiments). The acceleration grid 208 has a non-positive potential (such as 0 to −750 volts in various embodiments). Extraction of the ions from the plasma is accomplished by the difference in potential between the extraction grid 206 and the acceleration grid 208. For example, if the extraction grid 206 has a potential of 900 volts and the acceleration grid 208 has a potential of −150 volts, the ion beamlet 200 is extracted and has an extraction energy magnitude of 1050 eV at the acceleration grid 208. The difference between the potentials of the extraction grid 206 and the acceleration grid 208 is also a primary factor influencing the magnitude of the extracted ion beamlet current. According to Child's Law, the ion beam current that can be extracted is space charge limited but is proportional to the total extraction potential (i.e., the different between the extraction grid potential and the acceleration grid potential) raised to the 3/2 power.

As the ions pass through the acceleration grid 208, they tend to be strongly divergent (e.g., 10–30 degrees), as would be typical in a standard 2-grid system or 3-grid system of the prior art. However, the focus grid 210 applies a strong accelerating (i.e., negative) focus electrical potential, relative to the acceleration grid potential. The strong electric fields yielded by the significant difference between the potentials of the focus grid 210 and the acceleration grid 208 overwhelm the divergent components of the ion momentum vectors and re-focus the beamlet 200. In one embodiment, a negative focus electrical potential magnitude of two to three times the potential between the extraction grid 206 and the acceleration grid 208 is sufficient to refocus the beamlet 200. For example, if the extraction grid 206 has a potential of 900 volts and the acceleration grid 208 has a potential of −150 volts, the focus grid 210 should have a potential of between −2100 volts and −3150 volts.

The shield grid 212 applies a shield potential, such as 0 volts, to pull the neutralization plane into proximity of the shield grid 212. The shield grid potential also has a high potential difference from that of the focus grid 210, thereby rapidly decelerating the ion beamlet 200 at the shield grid 212. Therefore, by applying a strong accelerating focus potential to the focus grid 210, the ions are rapidly accelerated between the acceleration grid 208 and the focus grid 210 and then rapidly decelerated at the shield grid 212, thereby reducing the ion beam divergence as the ion beam 202 exits into the outer vacuum chamber. An exemplary range of shield grid potential spans from 0 volts to the same potential as the acceleration grid. In addition, by the time the ion beamlet 200 exits the 4-grid system, just passed the shield grid 212, the energy of the ion beamlet is 900 eV (i.e., 900 volts at the extraction grid 206 minus zero volts at the shield grid 212).

In one embodiment, an optimal focus grid potential is achieved by setting grid spacings, and grid shapes and thicknesses of the extraction grid, the acceleration grid, and the shield grid to obtain a desired ion beam energy for a traditional 3-grid configuration, although with a focus grid 210 inserted between the acceleration grid 208 and the shield grid 212. The traditional electrical potentials are applied to the extraction grid 206, acceleration grid 208, and shield grid 212 to obtain the desired ion beam energy. Thereafter, the angle of divergence of the resulting ion beam is detected while adjusting the focus grid potential by incrementally changing the focus grid potential until a minimum angle of divergence is detected.

Figure 3:
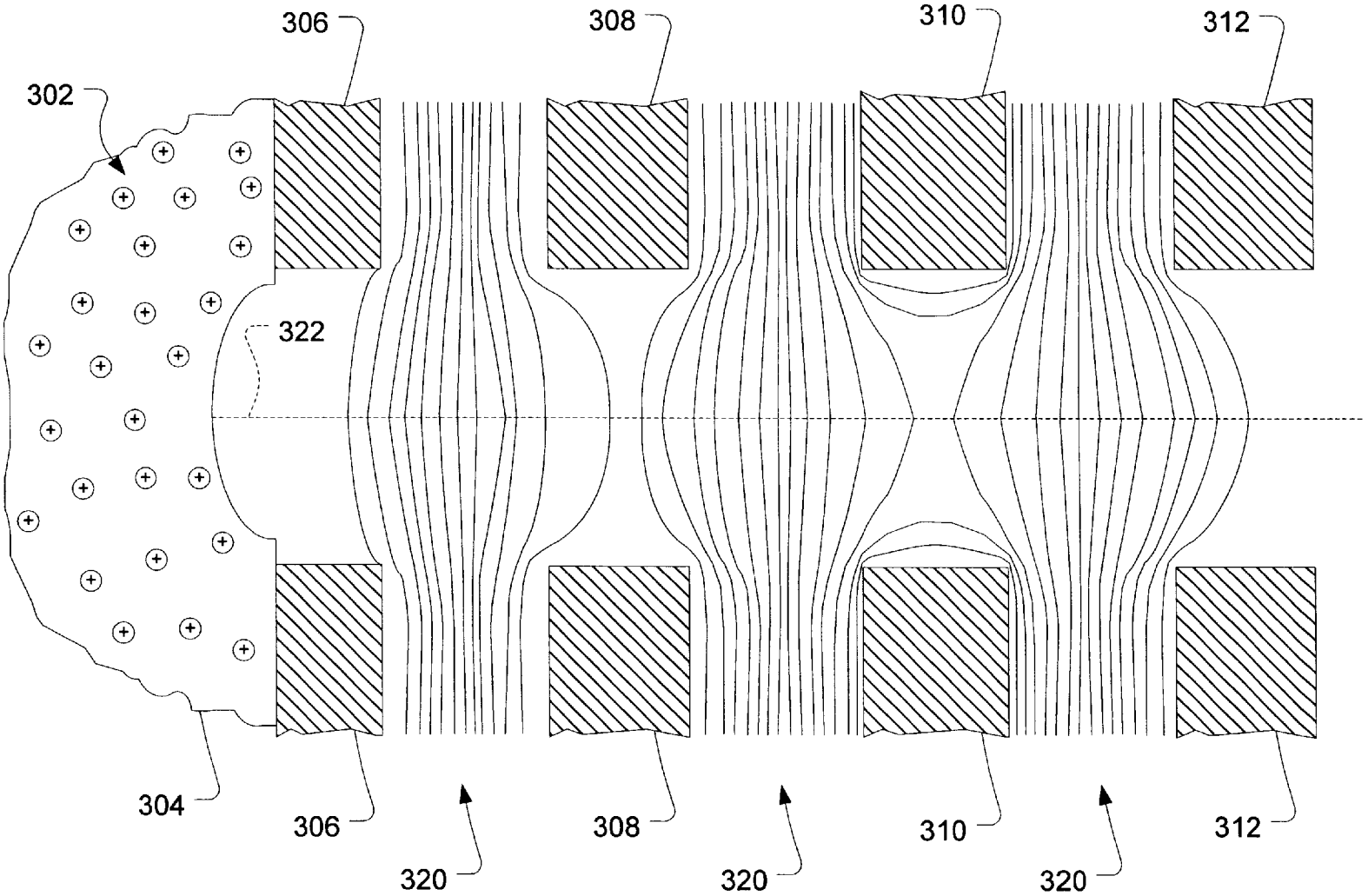
FIG. 3 schematically depicts equipotential associated with an aperture set of a 4-grid ion beam source in an embodiment of the present invention, wherein the focus grid has a high negative potential.

FIG. 3 schematically depicts equipotentials associated with an aperture set of a 4-grid ion beam source in an embodiment of the present invention, wherein the focus grid has a high negative potential. The 4-grid optics system includes an extraction grid 306 having an extraction grid potential of 900 volts, an acceleration grid 308 having an acceleration grid potential of −150 volts, a focus grid 310 having a focus grid potential of −2500 volts, and a shield grid 312 having a shield grid potential of 0 volts. The dashed line 322 shows a centerline through the aperture set of grid optics illustrated in FIG. 3. The lines 320 represent the equipotentials between the grids, based on the grid potentials, aperture geometries, grid thicknesses and shapes, and grid spacings.

Figure 4A:
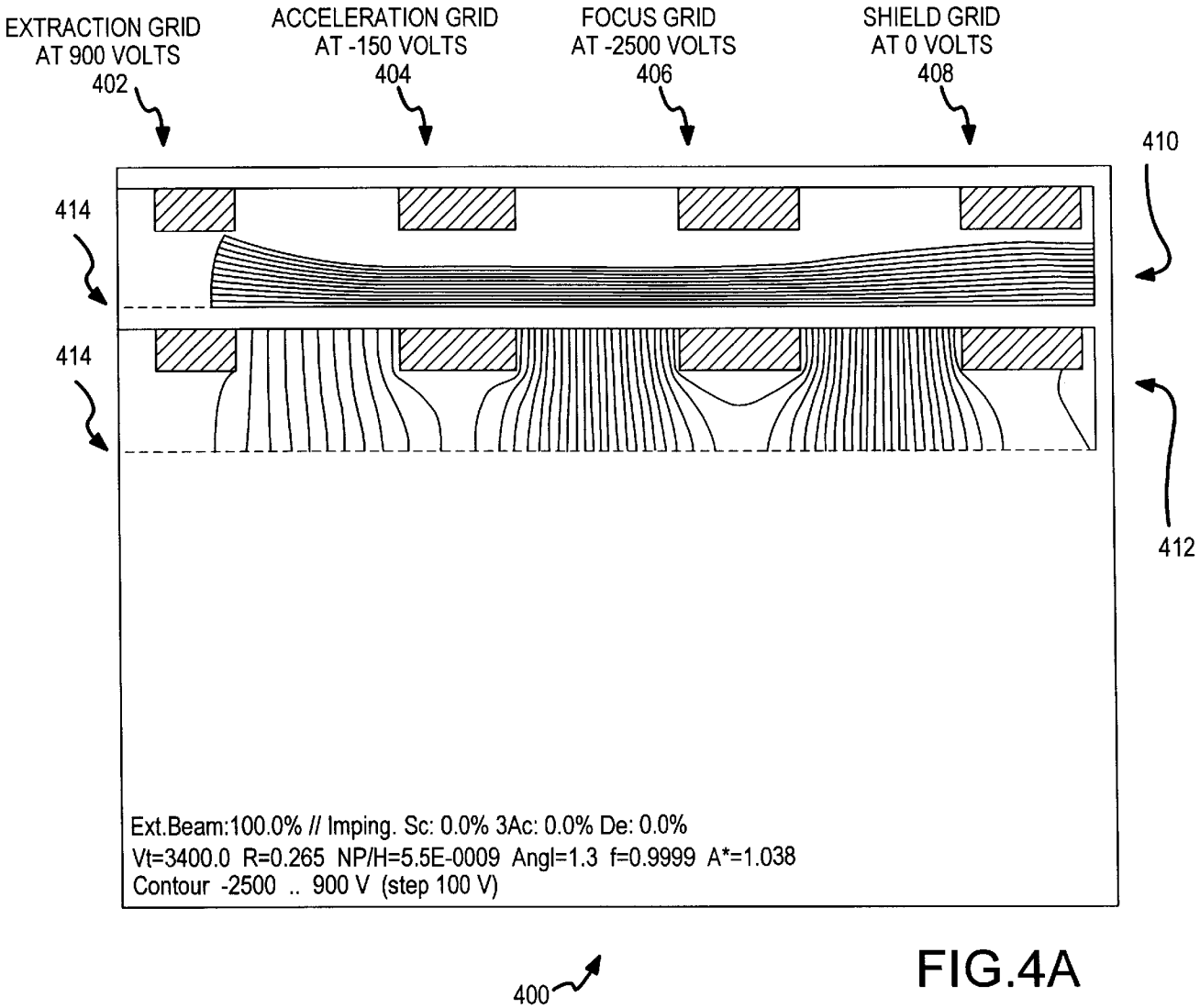
FIGS. 4A and 4B depict a screen printout showing simulation results of one embodiment of the present invention.

FIG. 4A depicts a screen printout showing simulation results of one embodiment of the present invention. The simulation results was generated using an ion optics simulation program called OPT, developed by Dr. Arakawa of the University of Tokyo, which models a 2-dimensional, axisymmetric beamlet. Program inputs characterize the grid geometries, grid potentials, plasma potential, electron temperature, perveance, and ion mass. The program computes trajectories of singly charged ions issuing normal from a calculated plasma sheath surface. Charge densities and potentials are calculated by solving a finite difference form of Poisson's equation. The program also calculates the beamlet divergence at a specified distance from the exit of the optics.

The screen shot 400 shows a simulated 4-grid ion beam source including an extraction grid 402 having an extraction grid potential of 900 volts, an acceleration grid 404 having an acceleration grid potential of −150 volts, a focus grid 406 having a focus grid potential of −2500 volts, and a shield grid 408 having a shield grid potential of zero volts. A simulated ion beamlet 410 is shown as being extracted from plasma (not shown) at the left of the screen shot 400 and being propelled toward a target (not shown) to the right of the screen shot 400. In contrast to the illustrations in FIGS. 2 and 3, only half of each aperture is shown; therefore, only the top half of the beamlet 410 is shown. The dotted line 414 marks the middle of the apertures and the middle of the beamlet 410.

The portion of the screen shot 400 indicated by the reference numeral 412 represents the simulated equipotentials between the grids and within the apertures. The simulation screen shot 400 represents a simulated 900 eV $Ar^+$ion beam. The spacings between grids and aperture diameters are all set at 2 mm. The grid thicknesses are set at 1.5 mm, except that the extraction grid thickness is 1.0 mm. The ion beam divergence angle has been calculated to be 1.3°.

Figure 4B:
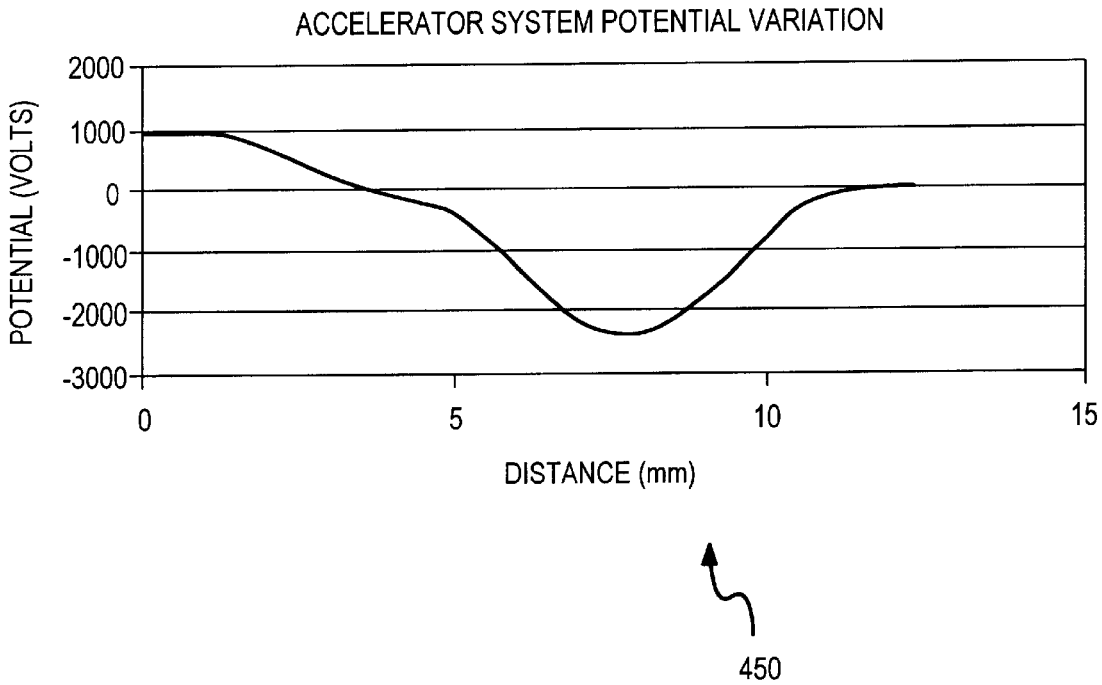

In summary, the results shown in FIGS. 4A and 4B represent simulated results of an optics system configuration defined by the following parameters:

| | | |
|---|---|---|
| Perveance of Beamlet ($(10^{-9}$ Amps/Volt$^{3/2})$) | = | 5.5 |
| Beam current of beamlet (A) | = | 149.7 |
| Ion Energy (eV) | = | 900 eV |
| Ion Type | = | Argon |
| Charge | = | +1 |

| Grid | Electrical Potential (volts) | Aperture Diameter (mm) | Grid Thickness (mm) | Spacing from Previous (Upstream) Grid (mm) |
|---|---|---|---|---|
| Extraction Grid | 900 | 2 | 1 | N/A |
| Acceleration Grid | −150 | 2 | 1.5 | 2 |
| Focus Grid | −2500 | 2 | 1.5 | 2 |
| Shield Grid | 0 | 2 | 1.5 | 2 |

FIG. 4B illustrates simulated potential variations along an axis of the optics system of FIG. 4A. The graph 450 includes a distance axis and a potential axis. The distance axis represents the distance from the most upstream surface of the extraction grid to the most downstream surface of the shield grid in an optics system. The potential axis represents the potential existing along the axis through the center of the apertures of an optics system.

Figure 5:
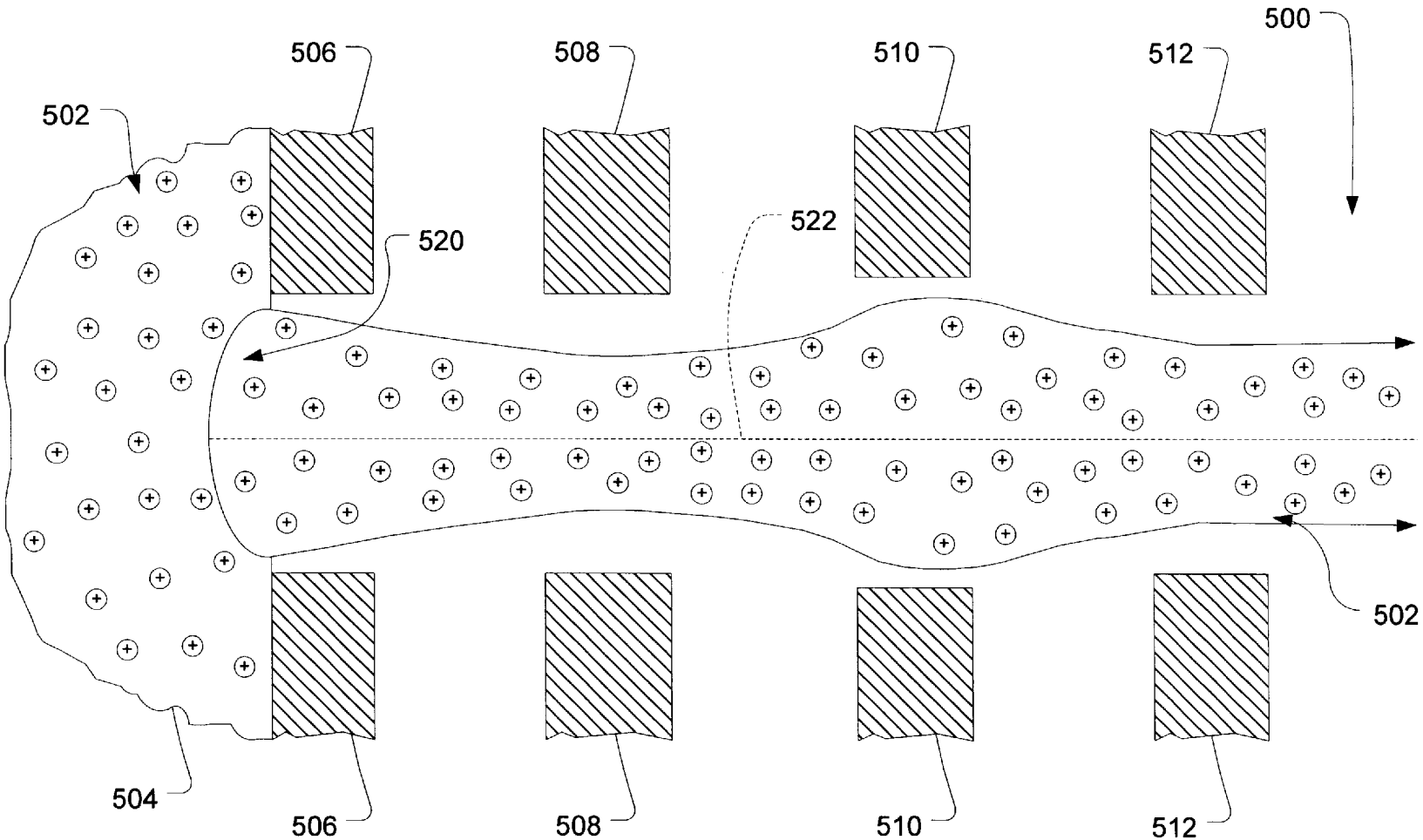
FIG. 5 schematically depicts an ion beamlet being extracted and propelled through an aperture set of a 4-grid ion beam source in an embodiment of the present invention, wherein the focus grid has a positive potential.

FIG. 5 schematically depicts an ion beamlet being extracted and propelled through an aperture set of a 4-grid ion beam source in an embodiment of the present invention, wherein the focus grid has a high positive potential. Ions 502 are extracted from plasma 504, which is temporarily stored in a plasma discharge chamber, such as shown in FIG. 1B. The plasma 504 tends to form a concave surface at an extraction point 520. The 4-grid optics system shown in FIG. 5 includes an extraction grid 506 having an extraction grid potential of 900 volts, an acceleration grid 508 having an acceleration grid potential of −150 volts, a focus grid 510 having a focus grid potential of 910 volts, and a shield grid 512 having a shield grid potential of −50 volts. During operation, positively charged ions 502 are extracted from the plasma discharge chamber at the extraction point 520 and propelled through the aperture set toward a target (not shown). The dashed line 522 shows a centerline axis through the aperture set of grid optics illustrated in FIG. 5, wherein the axis between the plasma source and the target representing the direction in which the ion beam travels. Each grid is mounted substantially normal to the axis.

In the illustrated embodiment, the extraction grid 506 has a high positive potential (such as 150 to 2500 volts in various embodiments). The acceleration grid 508 has a non-positive potential (such as 0 to −750 volts in various embodiments). Extraction of the ions from the plasma is accomplished by the difference in potential between the extraction grid 506 and the acceleration grid 508. For example, if the extraction grid 506 has a potential of 900 volts and the acceleration grid 508 has a potential of −150 volts, the ion beamlet 500 is extracted and has an energy magnitude of 1050 eV at the acceleration grid 508. The difference between the potentials of the extraction grid 506 and the acceleration grid 508 is also a primary factor influencing the magnitude of the extracted ion beamlet current. In addition, by the time the ion beamlet 500 exits the 4-grid system, just passed the shield grid 512, the energy of the ion beamlet is 1050 eV (i.e., 900 volts at the screen grid 506 plus 150 volts at the shield grid 512).

As the ions pass through the acceleration grid 508, they tend to be strongly divergent (e.g., 10–30 degrees), as would be typical in a standard 2-grid system or 3-grid system. However, the focus grid 510 applies a strong decelerating (i.e., positive) focus potential, relative to the acceleration grid potential. In one embodiment, a positive focus potential magnitude of about 80% of the difference between the potentials of the extraction grid 506 and the acceleration grid 508 (i.e., 80% of 1050 volts in the illustrated embodiment) is sufficient to refocus the beamlet 500.

The shield grid 512 applies a shield potential, such as 0 volts to an equal potential applied to the acceleration grid, to pull the neutralization plane close in close proximity to the shield grid 512, although a somewhat negative potential is preferred to prevent electrons from the neutralizing electron source in the vacuum chamber from entering the ion optics system. The shield grid potential also has a high potential difference from that of the focus grid 510, thereby rapidly accelerating the ion beamlet 500 at the shield grid 512. Therefore, by applying a strong decelerating focus potential to the focus grid 510, the ions are rapidly decelerated between the acceleration grid 508 and the focus grid 510 and then rapidly accelerated at the shield grid 512. The ions are further repulsed from the shield aperture walls, thereby reducing the ion beam divergence as the ion beam 502 exits into the outer vacuum chamber.

In one embodiment, an optimal focus grid potential is achieved by setting grid spacings, and grid shapes and thicknesses of the extraction grid, the acceleration grid, and the shield grid to obtain a desired ion beam energy and profile for a traditional 3-grid configuration, although with a focus grid 510 inserted between the acceleration grid 508 and the shield grid 512. The traditional electrical potentials are applied to the extraction grid 506, acceleration grid 508, and shield grid 512 to obtain the desired ion beam energy. (It should be understood that, when a high positive potential is to be applied to the focus grid 510, the shield grid 512 should initially be set to an appropriate negative potential to prevent a back current of electrons from the vacuum chamber. Also, in such embodiment, the potentials of the extraction grid 506 and acceleration grid 508 may be adjusted accordingly to obtain the desired ion beam energy.) Thereafter, the angle of divergence of the resulting ion beam is detected while adjusting the focus grid potential by incrementally changing the focus grid potential until a minimum angle of divergence is detected.

Figure 6:
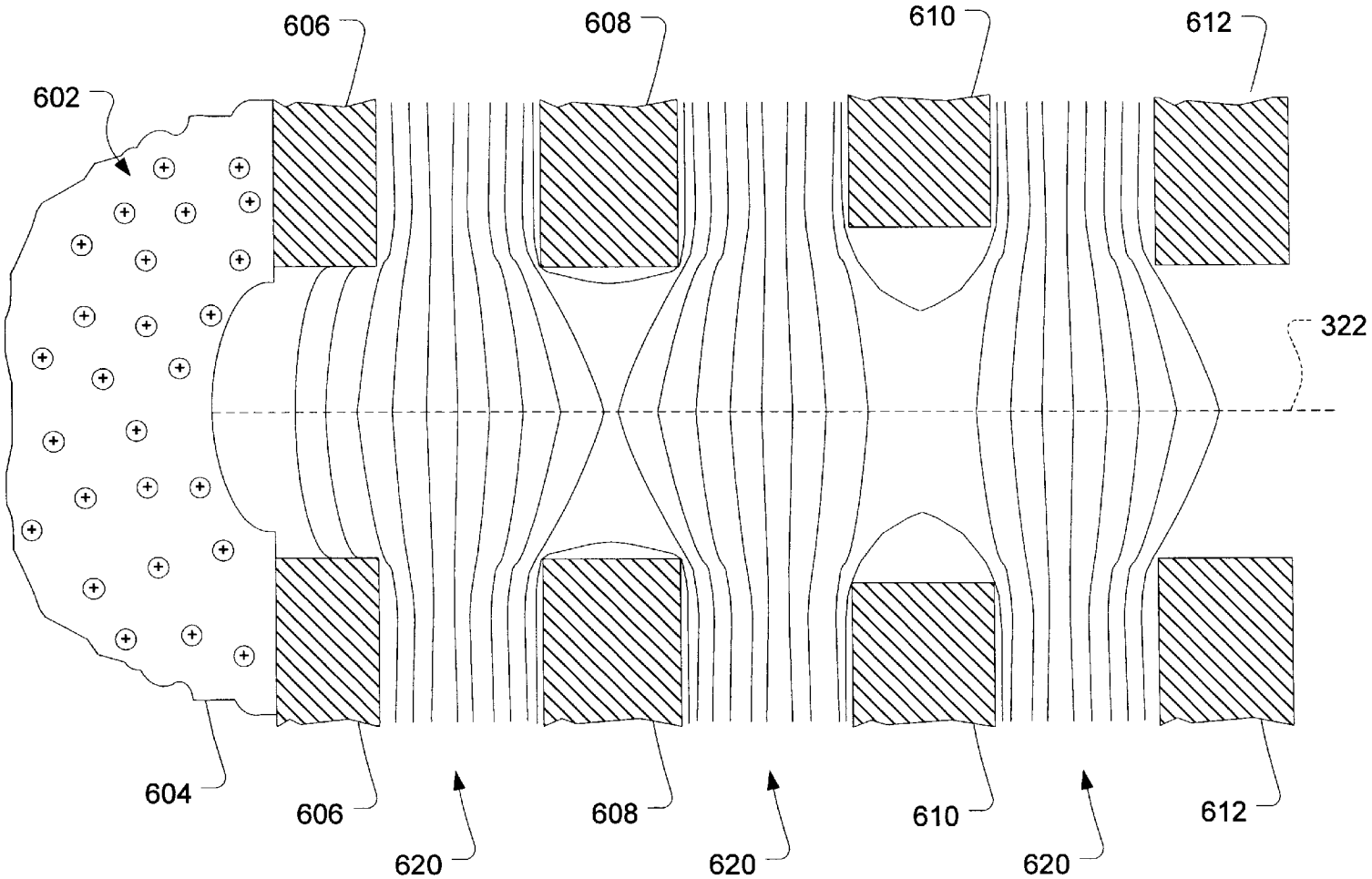
FIG. 6 schematically depicts equipotential associated with an aperture set of a 4-grid ion beam source in an embodiment of the present invention, wherein the focus grid has a positive potential.

FIG. 6 schematically depicts equipotentials associated with an aperture set of a 4-grid ion beam source in an embodiment of the present invention, wherein the focus grid has a high positive potential. The 4-grid optics system includes an extraction grid 606 having an extraction grid potential of 900 volts, an acceleration grid 608 having an acceleration grid potential of −150 volts, a focus grid 610 having a focus grid potential of 910 volts, and a shield grid 612 having a shield grid potential of −50 volts. The negative potential of the shield grid 612 prohibits electrons back-streaming into the ion optic system from the outer vacuum chamber, thereby shielding the strongly positive charged focus grid 610. The dashed line 622 shows a centerline through the aperture set of grid optics illustrated in FIG. 6. The lines 620 represent the equipotentials between the grids, based on the grid potentials, aperture geometries, grid thicknesses and shapes, and grid spacings.

Figure 7A:
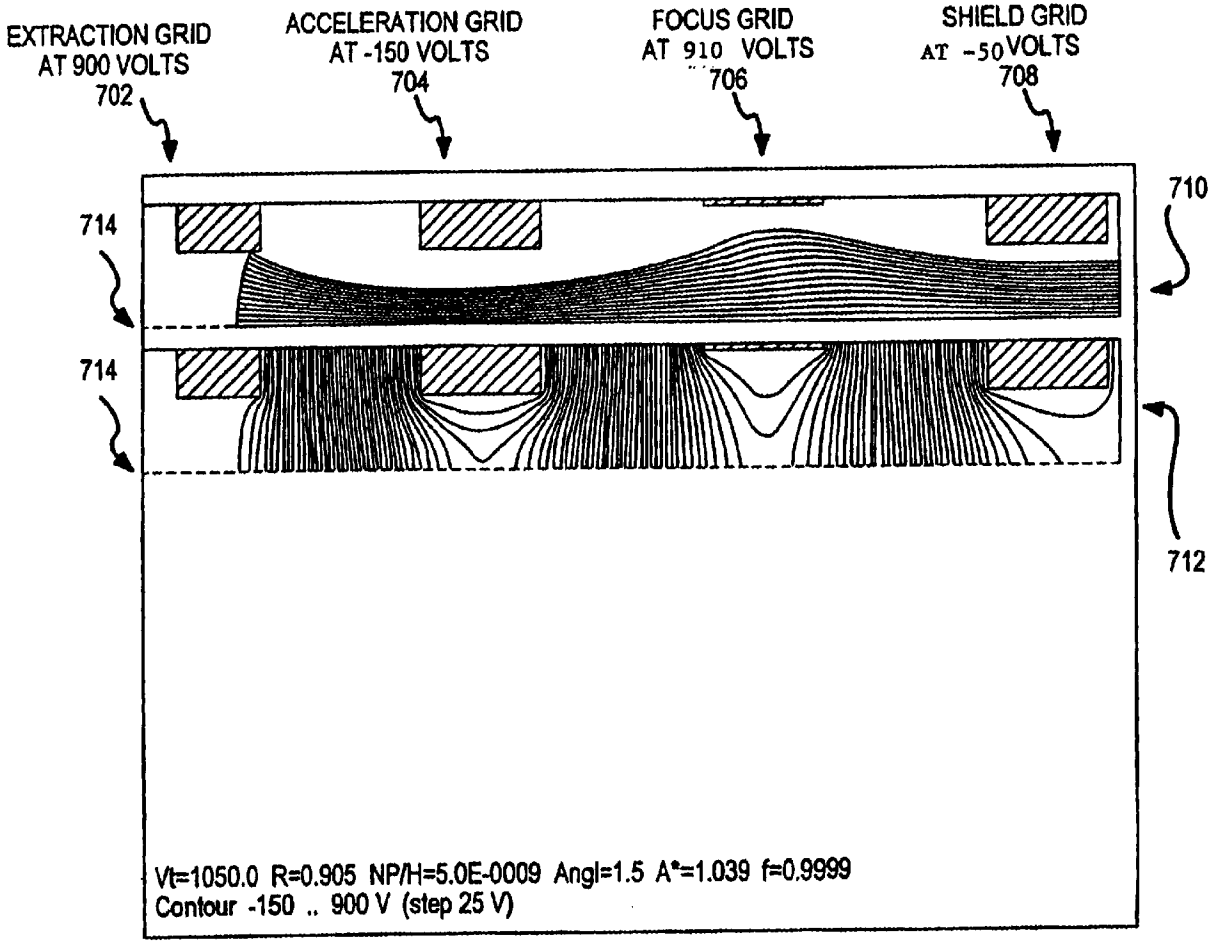
FIGS. 7A and 7B depict a screen printout showing simulation results of one embodiment of the present invention.

FIG. 7A depicts a screen printout showing simulation results of one embodiment of the present invention. The simulation results were generated using the OPT ion optics simulation program.

The screen shot 700 shows a simulated 4-grid ion beam source including an extraction grid 702 having an extraction grid potential of 900 volts, an acceleration grid 704 having an acceleration grid potential of −150 volts, a focus grid 706 having a focus grid potential of 910 volts, and a shield grid 708 having a shield grid potential of −5 0 volts. A simulated ion beamlet 710 is shown as being extracted from plasma (not shown) at the left of the screen shot 700 and being propelled toward a target (not shown) to the right of the screen shot 700. In contrast to the illustrations in FIGS. 5 and 6, only half of each aperture is shown; therefore, only the top half of the beamlet 710 is shown. The dotted line 714 marks the middle of the apertures and the middle of the beamlet 710.

The portion of the screen shot 700 indicated by the reference numeral 712 represents the simulated equipotentials between the grids and within the apertures. The simulation screen shot 700 represent of a simulated 900 eV $Ar^+$ ion beam. The spacings between grids and aperture diameters are all set at 2 mm. The grid thicknesses are set at 1.5 mm, except that the extraction grid thickness is 1.0 mm. The ion beam divergence angle has been calculated to be 1.5° at a distance of 1.2 meters downstream of the shield grid 708.

Figure 7B:
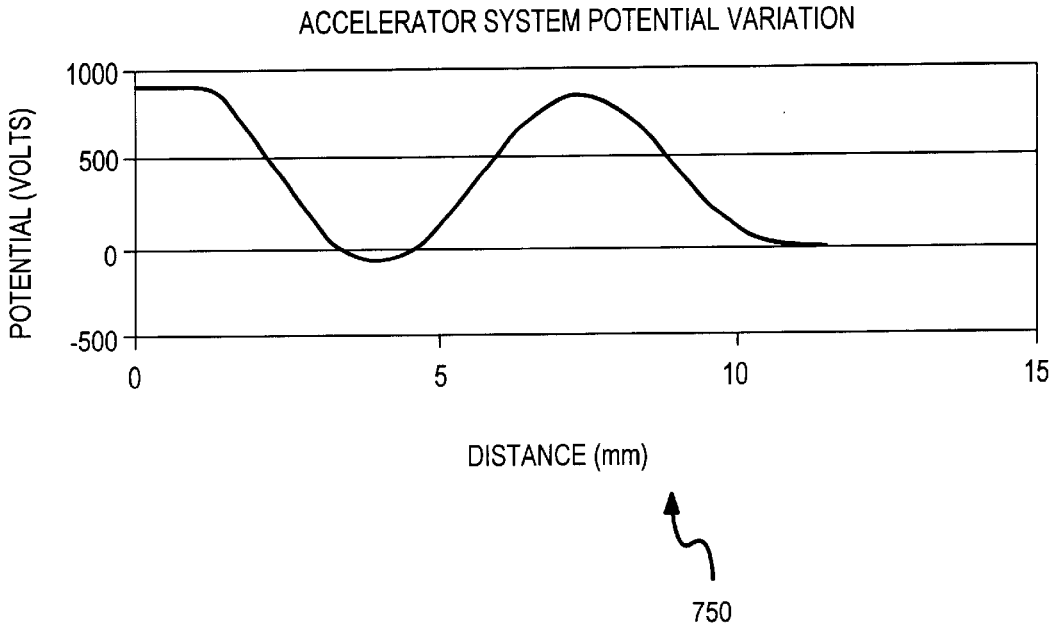

In summary, the results shown in FIGS. 7A and 7B represent simulated results of an optics system configuration defined by the following parameters:

| | | |
|---|---|---|
| Perveance of Beamlet ($10^{-9}$ Amps/Volt$^{3/2}$) | = | 5.0 |
| Beam current of beamlet (A) | = | 125.0 |
| Ion Energy (eV) | = | 900 eV |
| Ion Type | = | Argon |
| Charge | = | +1 |

| Grid | Electrical Potential (volts) | Aperture Diameter (mm) | Grid Thickness (mm) | Spacing from Previous (Upstream) Grid (mm) |
|---|---|---|---|---|
| Extraction Grid | 900 | 1.8 | 1 | N/A |
| Acceleration Grid | −150 | 1.8 | 1.5 | 2 |
| Focus Grid | 910 | 2.8 | 1.5 | 2 |
| Shield Grid | −50 | 1.8 | 1.5 | 2 |

FIG. 7B illustrates simulated potential variations along an axis of the optics system of FIG. 7A. The graph 750 includes a distance axis and a potential axis. The distance axis represents the distance from the most upstream surface of the extraction grid to the most downstream surface of the shield grid in an optics system. The potential axis represents the potential existing along the axis through the center of the apertures of an optics system.

Figure 8A:
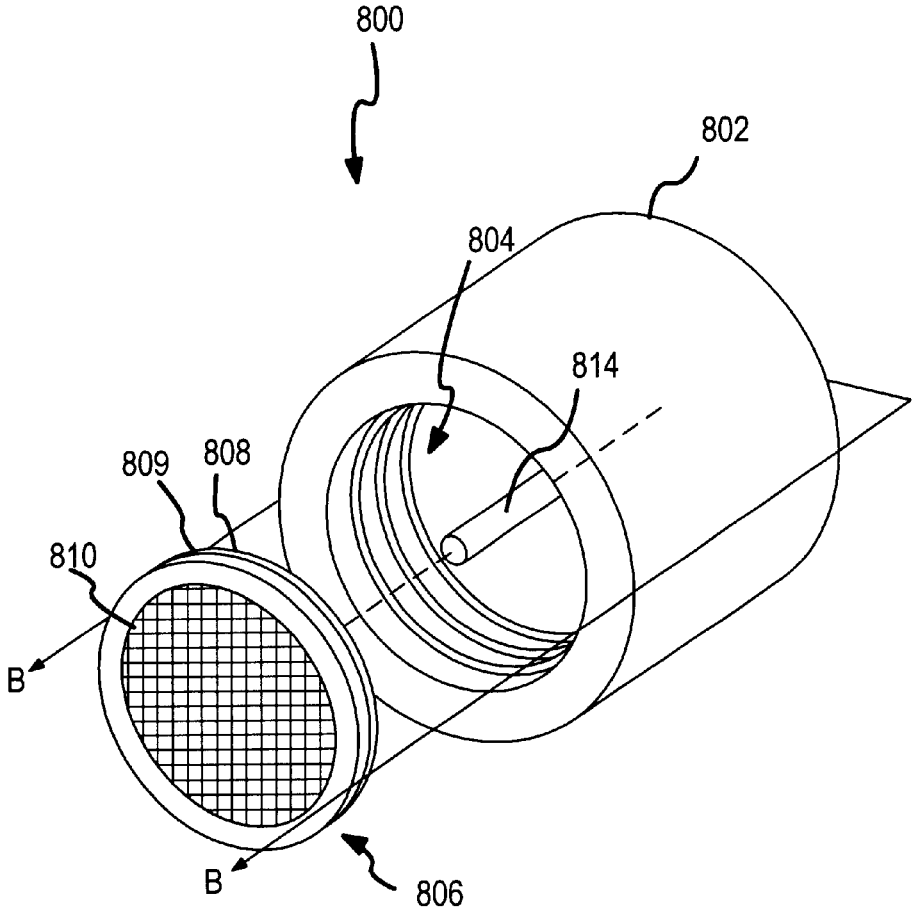
FIG. 8A depicts a generalized three-dimensional view of a circular 4-grid ion beam source in an embodiment of the present invention.
Figure 8B:
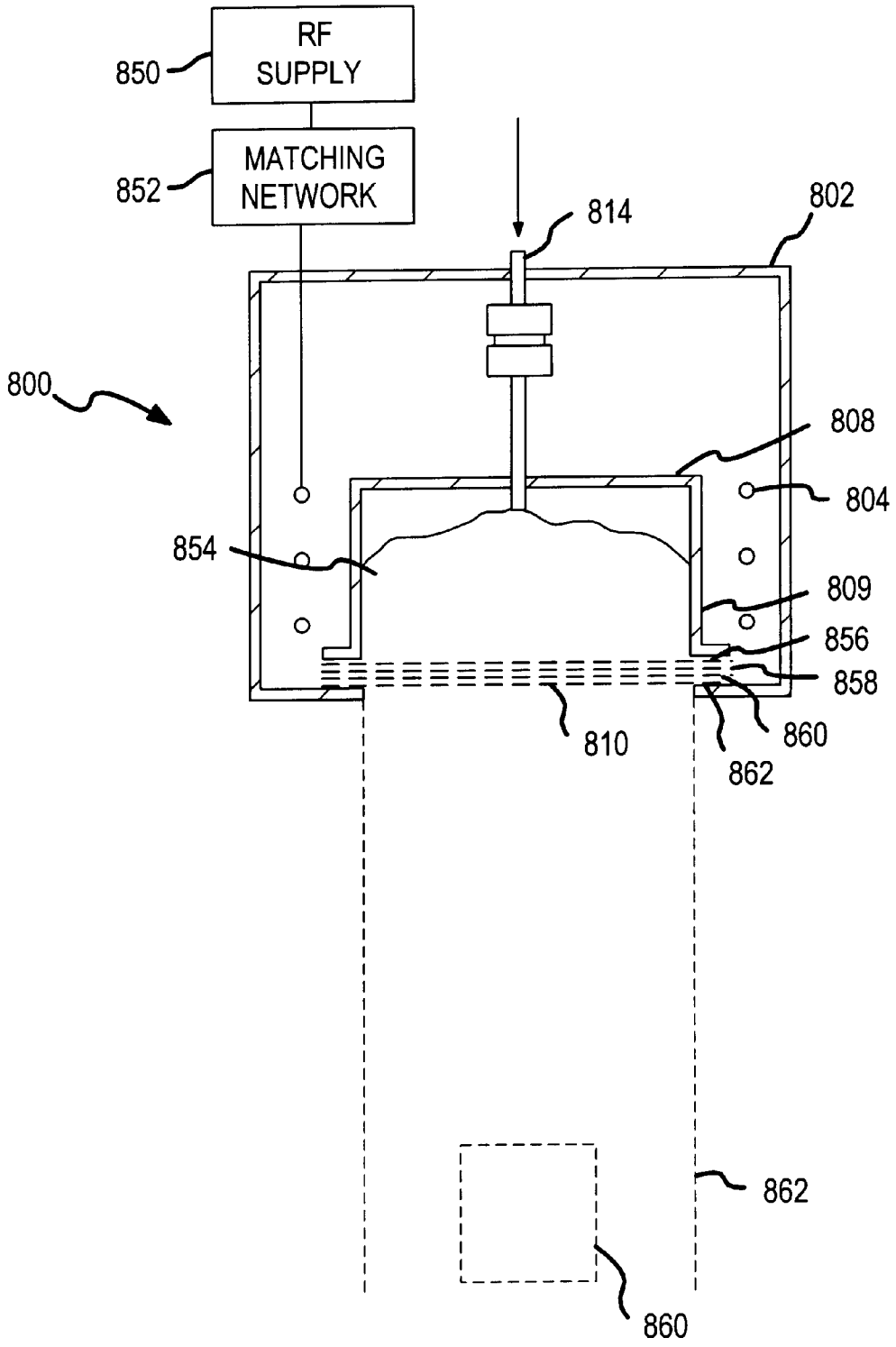
FIG. 8B depicts a cross sectional view of the ion beam source shown in FIG. 8A.

FIG. 8A depicts a generalized three-dimensional view of a circular 4-grid ion beam source 800 in an embodiment of the present invention. FIG. 8B depicts a cross sectional view of the ion beam source 800 shown in FIG. 8A with plasma 854 shown in the plasma discharge chamber 809. During operation, the 4-grid ion beam source is positioned in a high vacuum chamber with a pressure of about $1\times10^{-4}$ torr to $5\times10^{-4}$ torr. A shroud 802 partially encloses an inductive radio frequency (RF) coil 804 supported by coil insulators and a high voltage isolated gas inlet line 814 The radio frequency (RF) coil 804, which may be coiled about the plasma chamber 809, is driven at 13.56 MHz using a 1 KW power supply 850 through a capacitive matching network 852. A direct current plasma discharge may also be employed to generate the plasma in an alternative embodiment.

A grid system 806 attaches to the shroud 802 to fully enclose the RF coil 804 within the shroud 802. The grid system 806 includes an array of four grids 810 (i.e., an extraction grid 856 an acceleration grid 858 a focus grid 860, and a shield grid 862) and a dielectric window 808 to the plasma discharge chamber 809. Each grid comprises a pattern of apertures through its surface to allow ions to pass through the grid. When positioned within the grid system 806, the apertures of each grid are substantially aligned or coaxial with the apertures of each of the other grid, although some variation of alignment may be used to obtain a required beam profile. On one embodiment of the present invention, all of the grids in the 4-grid system 806 are flat. However, in alternative embodiments, one or more of the grids may be "dished" or curved without departing from the present invention.

The gas intake line 814 inserts through the dielectric window 808 into the plasma discharge chamber 809. During operation, a gas, including without limitation argon, oxygen, nitrogen, methane (or other carbon containing gas), xenon, or krypton, is input to the gas intake line 814 and ionized as the gas enters the plasma discharge chamber 809 and passes the RF coil 804. As a result, ionized particles of the gas are flushed into the plasma discharge chamber 809 to form plasma 854 The dielectric window 808 is capacitively coupled to the RF coil 804 to sustain the plasma 854 in the plasma discharge chamber 809. The extraction grid 856 the acceleration grid 858 the focus grid 860, and the shield grid 862 extract ions from the plasma discharge chamber 809 and propel the ions through the apertures in the grids 810 toward a target 860 in the form of an ion beam 862.

Figure 9:
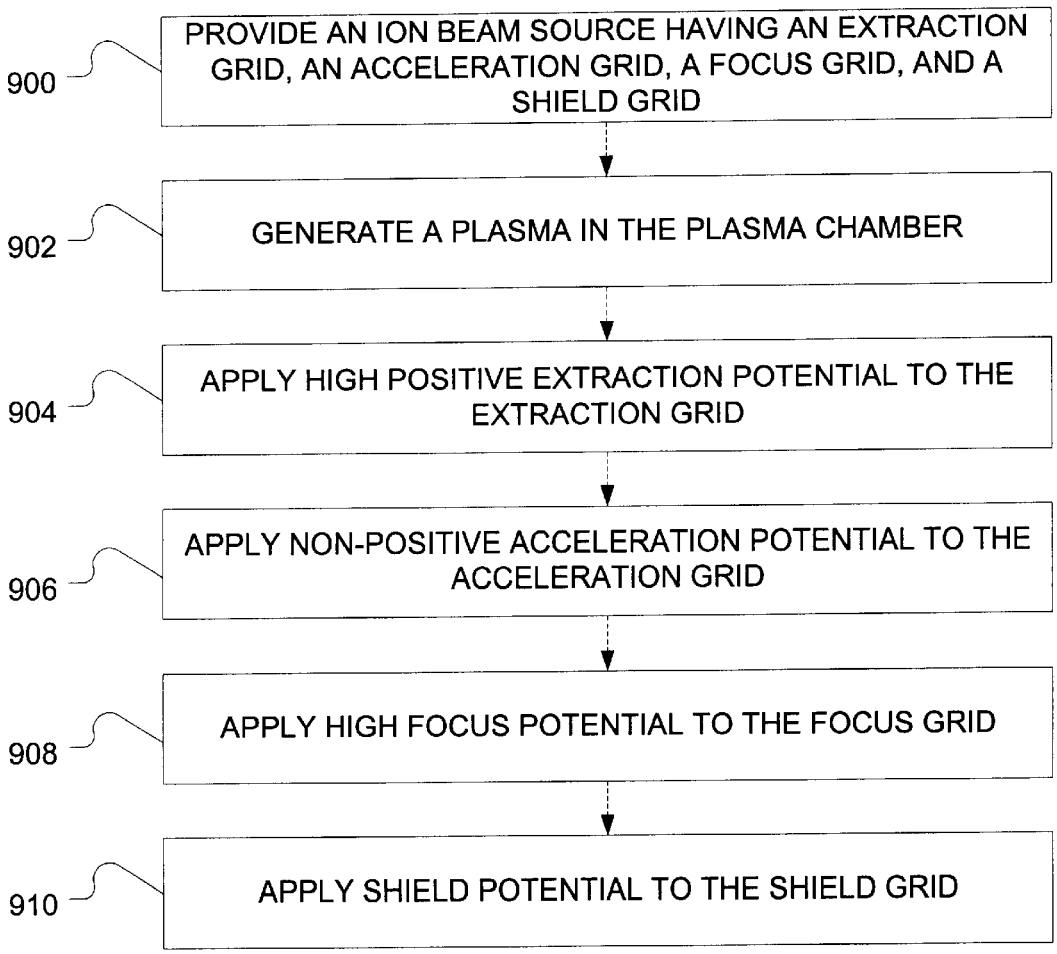
FIG. 9 depicts operations for generating an ion beam from a 4-grid ion beam source in an embodiment of the present invention.

FIG. 9 depicts operations for generating an ion beam from a 4-grid ion beam source in an embodiment of the present invention. A sourcing operation 900 provides an ion beam having an extraction grid, an acceleration grid, a focus grid, and a shield grid arranged in progressive order along and normal to an axis extending from a plasma source to a target. Exemplary configurations are shown in FIGS. 2 and 5, although other physical configurations are contemplated within the scope of the present invention. A generating operation 902 generates plasma in a plasma chamber of the plasma source.

An extraction operation 904 applies a high positive electrical extraction potential (e.g., 900 volts) to the extraction grid. An acceleration operation 906 applies a non-positive electrical acceleration potential to the acceleration grid. The difference between the extraction potential and the acceleration potential are a primary factor controlling the ion beam current extracted from the plasma source. The extracted ions forms an ion beam propelled substantially away from the plasma source.

A focusing operation 908 applies an electrical focus potential to the focus grid to focus the ion beam into a more highly collimated ion beam, subject to the influence of the shield grid. A shielding operation 910 applies an electrical shield potential to the shield grid to locate the neutralization plane near the shield grid. The electrical focus potential changes the momentum of the ions to compliment the electrical shield potential of the shield grid to produce a highly collimated ion beam directed toward the target.

Figure 10A:
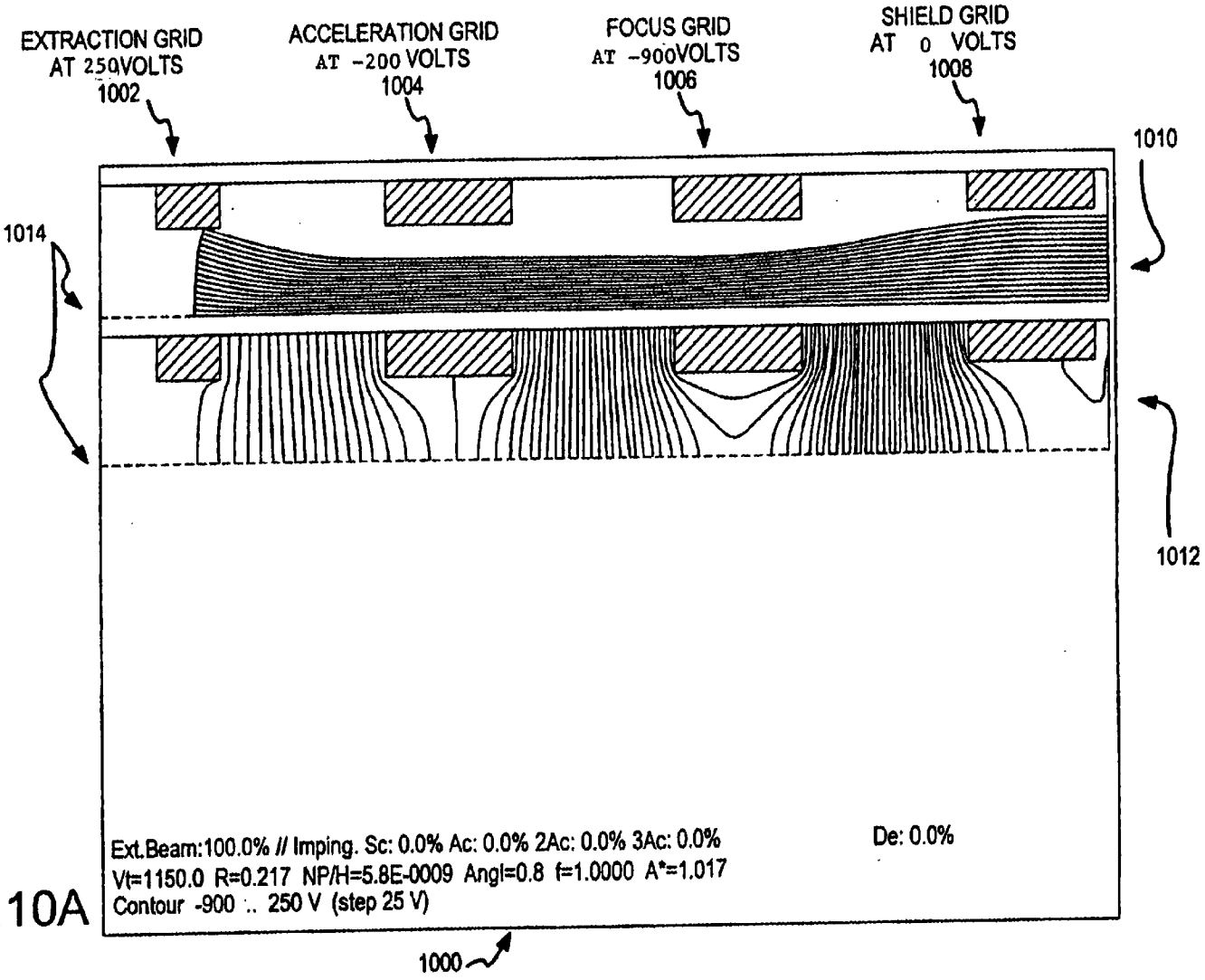
FIGS. 10A and 10B illustrate simulation results relating to a configuration of an exemplary low energy beam source in an embodiment of the present invention.
Figure 10B:
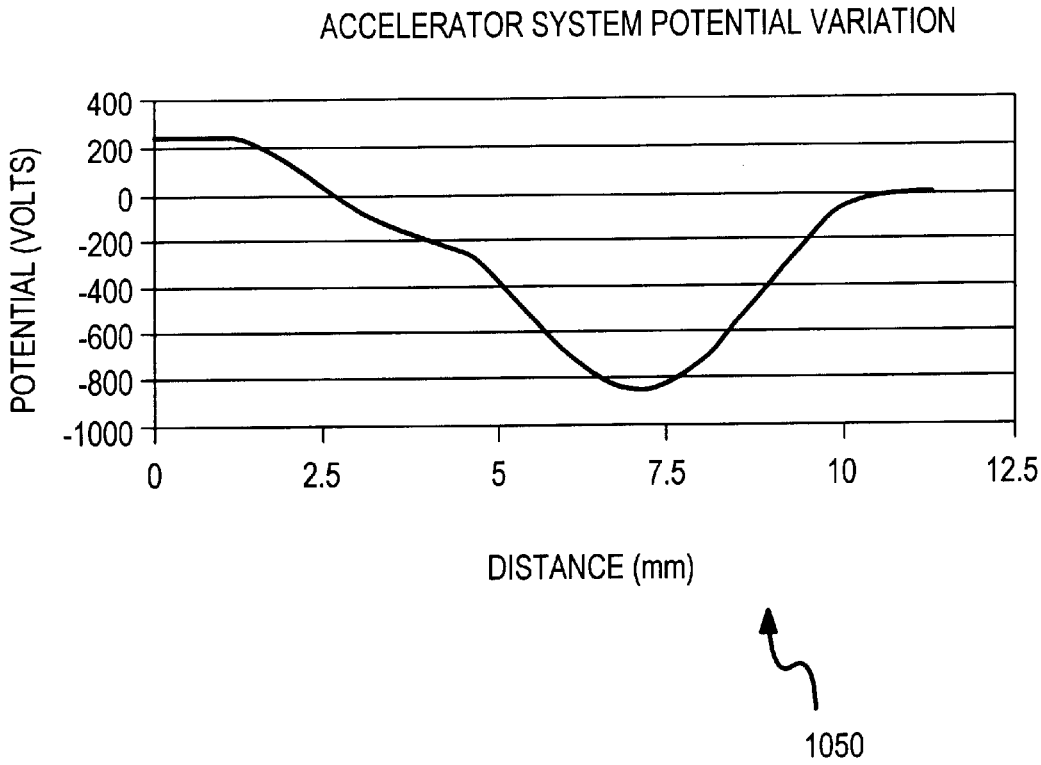

In an alternative embodiment, a low energy ion beam may be generated, such as used for flat panel display applications. Simulation results corresponding to the low energy configuration having a negative focus grid are shown in FIG. 10A and 10B. The resultant divergence angle achieved by the simulated configuration is 0.8 degrees.

In summary, the results shown in FIGS. 10A and 10B represent simulated results of an optics system configuration defined by the following parameters:

| | | |
|---|---|---|
| Perveance of Beamlet ($10^{-9}$ Amps/Volt$^{3/2}$) | = | 5.8 |
| Beam current of beamlet (A) | = | 44.29 |
| Ion Energy (eV) | = | 250 eV |
| Ion Type | = | Argon |
| Charge | = | +1 |

| Grid | Electrical Potential (volts) | Aperture Diameter (mm) | Grid Thickness (mm) | Spacing from Previous (Upstream) Grid (mm) |
|---|---|---|---|---|
| Extraction Grid | 250 | 2 | 0.762 | N/A |
| Acceleration Grid | −200 | 2 | 1.52 | 2 |
| Focus Grid | −900 | 2 | 1.52 | 2 |
| Shield Grid | 0 | 2.2 | 1.52 | 2 |

FIG. 10B illustrates simulated potential variations along an axis of the optics system of FIG. 10A. The graph 1002 includes a distance axis and a potential axis. The distance axis represents the distance from the most upstream surface of the extraction grid to the most downstream surface of the shield grid in an optics system. The potential axis represents the potential existing along the axis through the center of the apertures of an optics system.

Figure 14A:
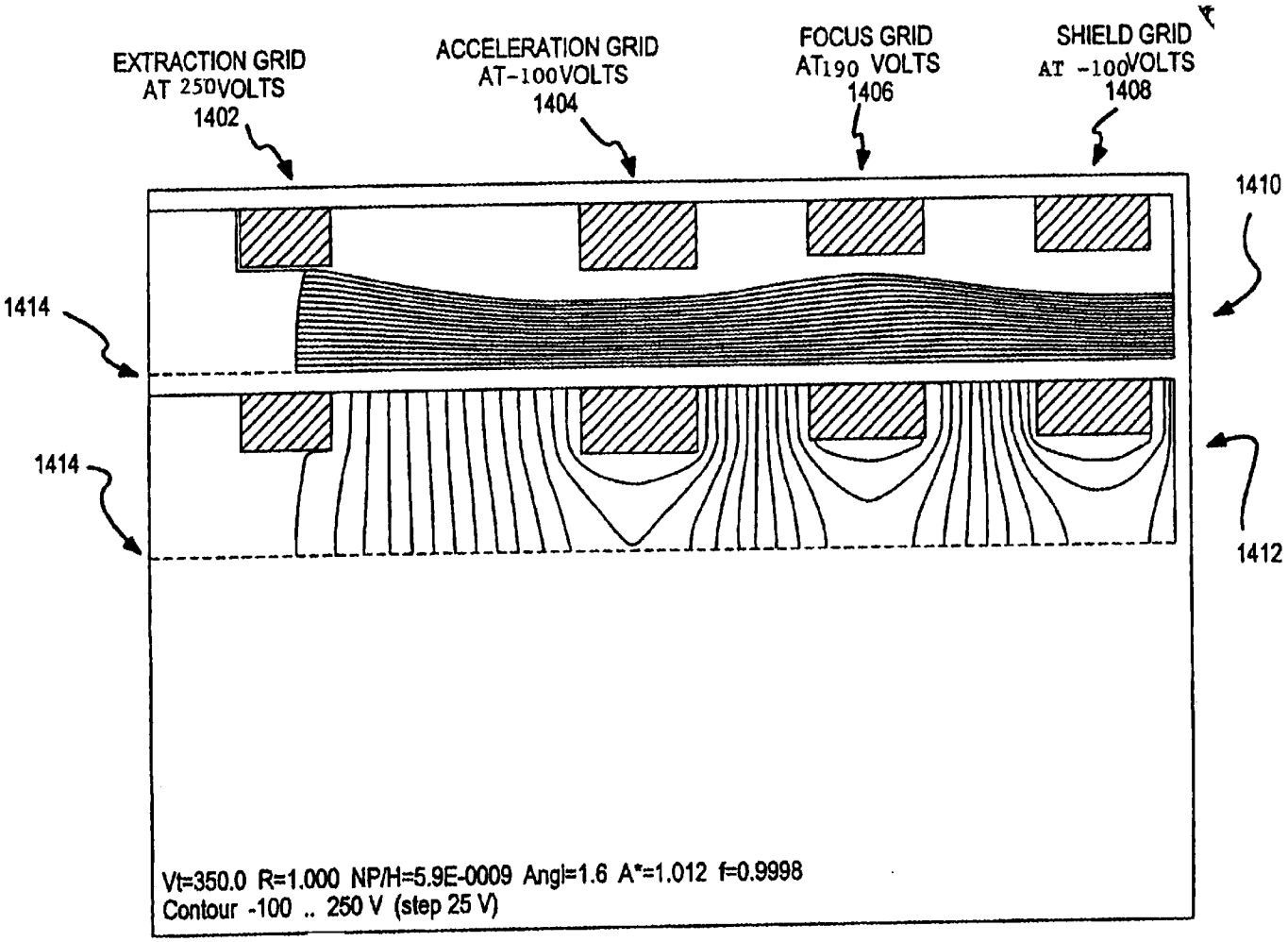
FIGS. 14A and 14B illustrate simulation results of another 4-grid ion beam source in an embodiment of the present invention.
Figure 14B:
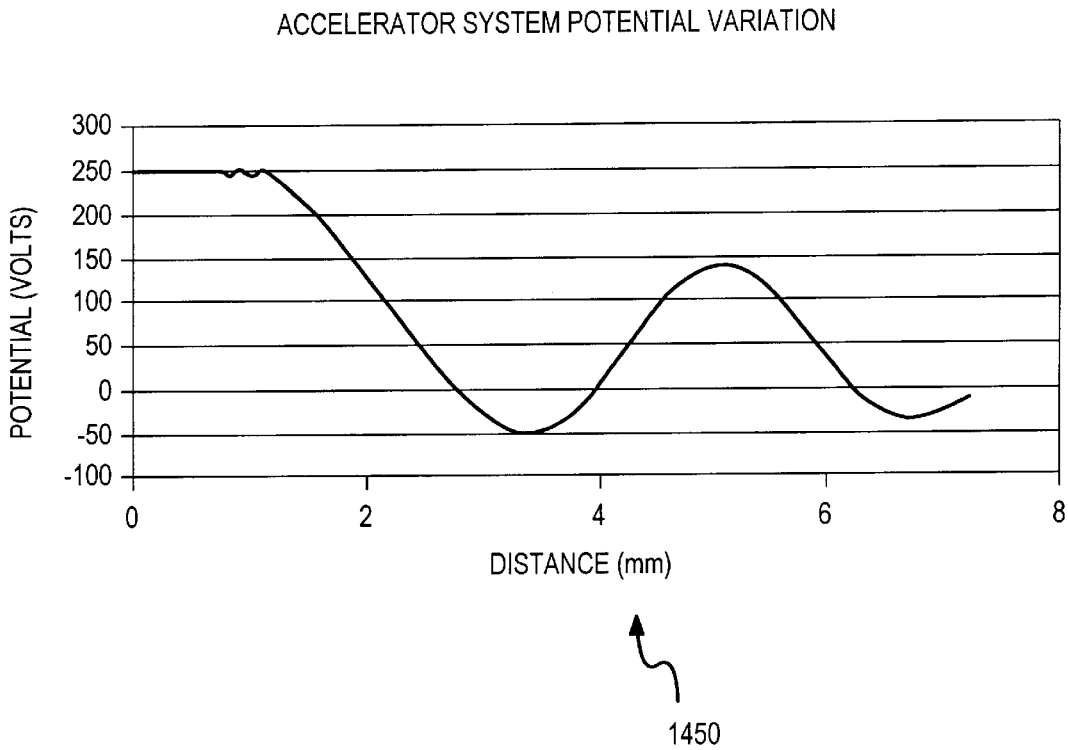

In yet another alternative embodiment, a low energy ion beam may be generated, such as used for flat panel display applications. Simulation results corresponding to the low energy configuration having a positive focus grid are shown in FIGS. 14A and 14B. The resultant divergence angle achieved by the simulated configuration is 1.6 degrees.

In summary, the results shown in FIGS. 14A and 14B represent simulated results of an optics system configuration defined by the following parameters:

| | | |
|---|---|---|
| Perveance of Beamlet (($10^{-9}$ Amps/Volt$^{3/2}$) | = | 5.9 |
| Beam current of beamlet (A) | = | 30.9 |
| Ion Energy (eV) | = | 250 eV |
| Ion Type | = | Argon |
| Charge | = | +1 |

| Grid | Electrical Potential (volts) | Aperture Diameter (mm) | Grid Thickness (mm) | Spacing from Previous (Upstream) Grid (mm) |
|---|---|---|---|---|
| Extraction Grid | 250 | 2 | 0.7 | N/A |
| Acceleration Grid | −100 | 1.8 | 0.9 | 2 |
| Focus Grid | 190 | 2 | 0.9 | 0.9 |
| Shield Grid | −100 | 2 | 0.9 | 0.9 |

FIG. 14B illustrates simulated potential variations along an axis of the optics system of FIG. 14A. The graph 1402 includes a distance axis and a potential axis. The distance axis represents the distance from the most upstream surface of the extraction grid to the most downstream surface of the shield grid in an optics system. The potential axis represents the potential existing along the axis through the center of the apertures of an optics system.

Figure 11:
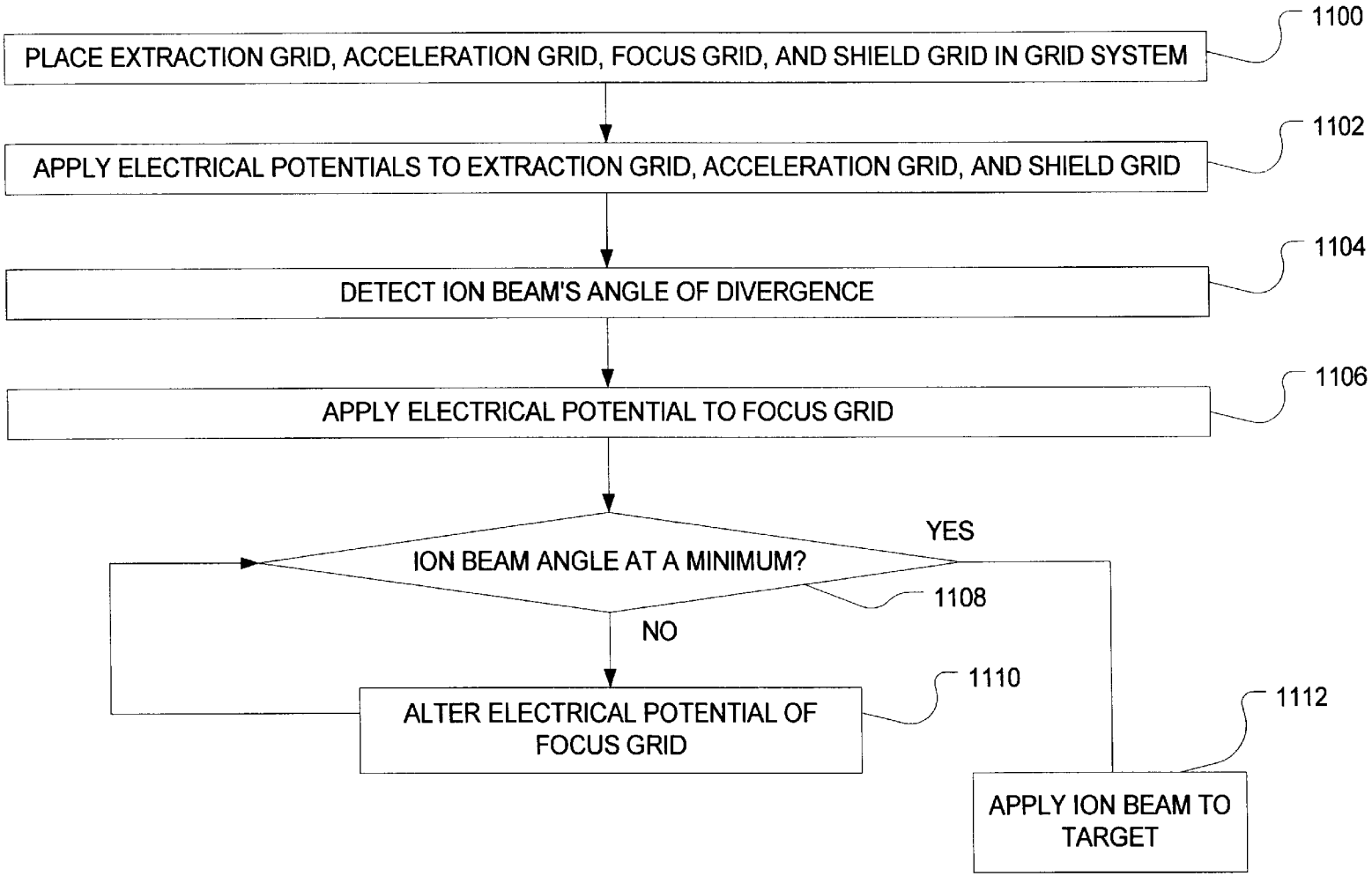
FIG. 11 depicts operation for focusing an ion beam using a focus grid in an embodiment of the present invention.

FIG. 11 depicts operation for focusing an ion beam using a focus grid in an embodiment of the present invention. A placement operation 1100 places the extraction grid, the acceleration grid, the focus grid and the shield grid in a grid system of an ion beam source. An energizing operation 1102 applies electrical potentials to the extraction grid, the acceleration grid, and the shield grid to obtain the desired energy level of the ion beam.

A detection operation 1104 detects the angle of ion beam divergence. The "ion beam divergence angle" is the truncated cone angle enclosing 95% of the total integrated beam current. To detect said angle, the ion beam current profile by positioning a hollow cavity (e.g., a box or cylinder) that has a well defined entrance aperture a known distance downstream of the ion beam source. Internal to the cavity is an electrically isolated electrode (i.e., isolated from cavity) that is connected to a current meter. Ions enter the cavity and impact the electrode, depositing charge that is measured by the current meter. This simple device is referred to in the literature as a "Faraday Cup". The ion current density or "flux" at the point where the Faraday cup is positioned can be calculated from the ion current and aperture diameter. If the Faraday cup is scanned across the width or diameter of the ion beam, multiple measurements of the ion beam current density can be made. These measurements determine the ion beam profile.

The divergence angle can be calculated by measuring the truncated cone angle enclosing 95% of the total integrated beam current. Starting with a round ion source that has diameter D, an ion beam profile can be measured at some distance L away from the source. This profile will have a diameter D' defined as enclosing 95% of the beam. The divergence angle Alpha is calculated from the following expression:

$$\text{Alpha}=\tan^{-1}[(D'/2-D/2)/L]$$

An energizing operation 1106 applies an electrical potential to the focus grid. It should be understood that at least operations 1104 and 1106 can be interchanged in the order of operation. That is, the application of the electrical potential to the focus grid may be commenced prior to the detection of the angle of divergence. Note, however, that the order of the described operations in FIGS. 9 and 11 are exemplary only and should not be ready to limit the order of operations in the present invention.

A decision operation 1108 determines whether the ion beam divergence angle is at a minimum. If not, an altering operation 1110 alters the electrical potential applied to the focus grid. The altering operation 1110 may incrementally or randomly increase or decrease the electrical potential to tune (e.g., minimize) the divergence of the ion beam. Various optimization algorithms may be used including a simple hill climbing optimization, simulated annealing, and other approaches. In addition, a simulated starting point may be applied at energizing operation 1106 from which the altering operation 1110 changes the applied potential to the focus grid in search for the minimum beam divergence. When the divergence angle of the ion beam has been minimized by alteration of the focus beam potential, the ion beam is applied to the target in an application operation 1112.

Figure 12A:
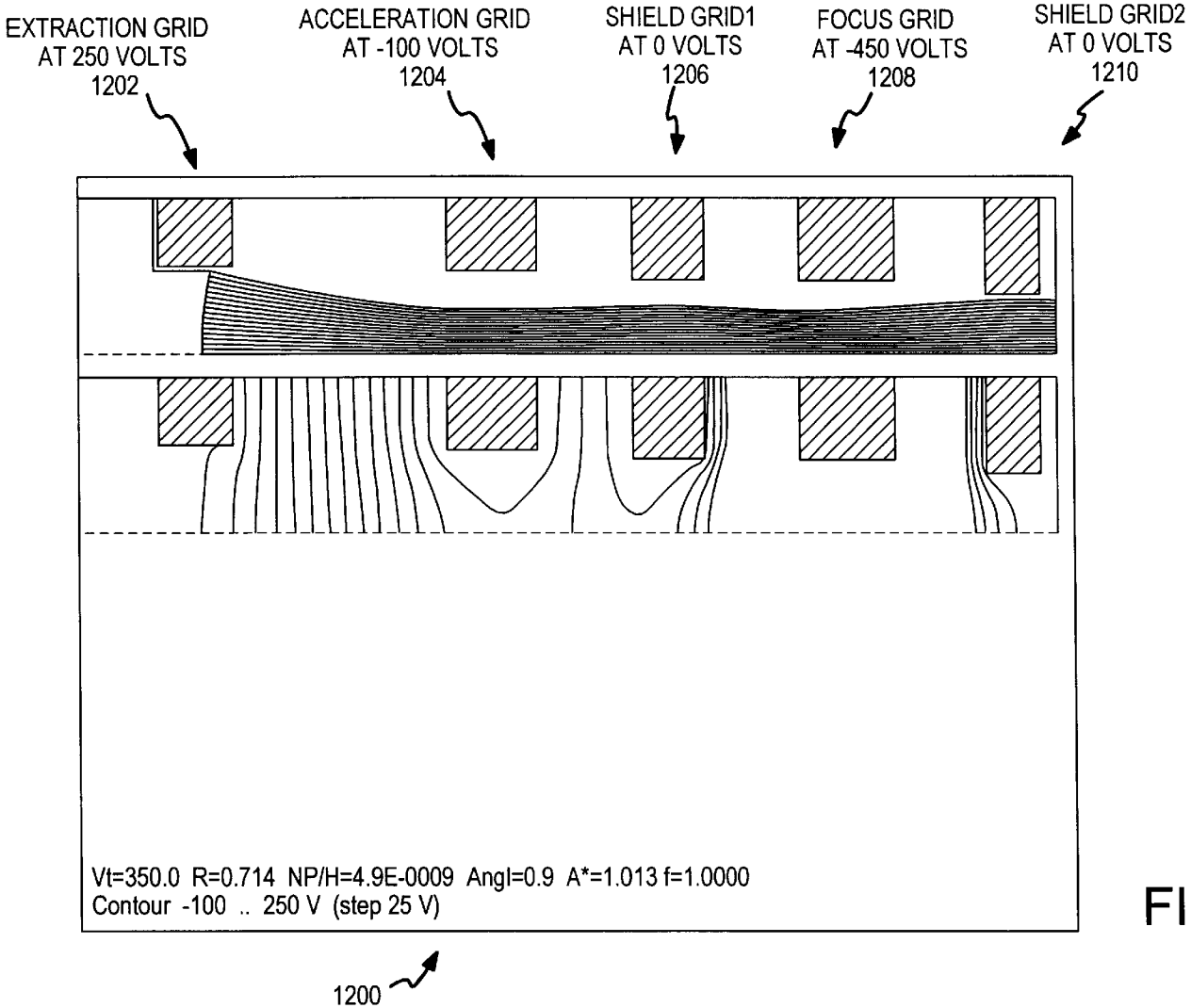
FIGS. 12A and 12B illustrate simulation results of a 5-grid ion beam source in an embodiment of the present invention.
Figure 12B:
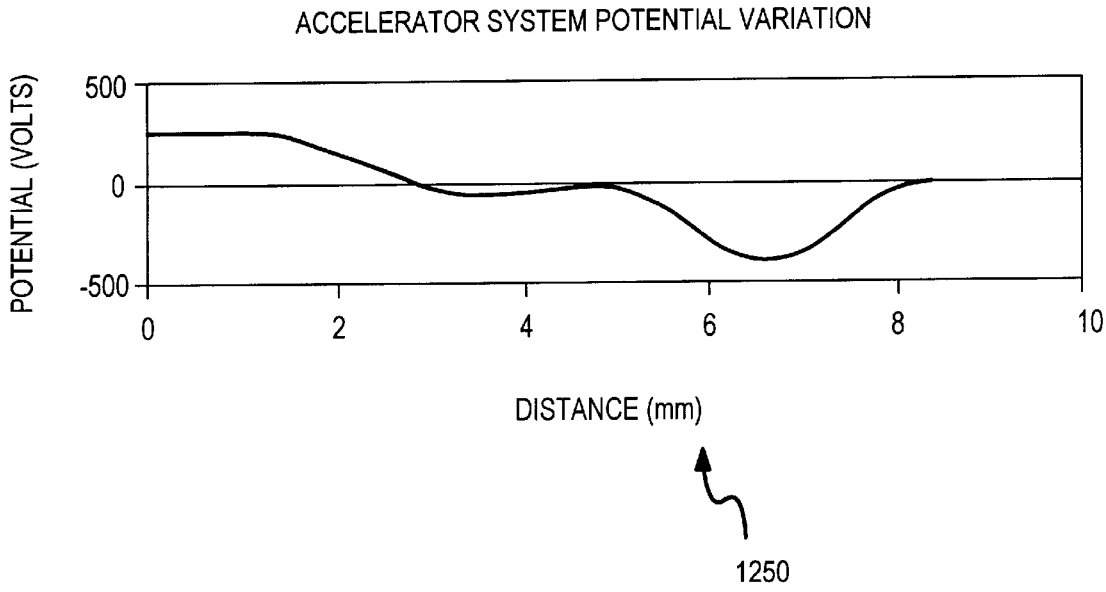

FIGS. 12A and 12B illustrate simulation results of a 5-grid ion beam source in an embodiment of the present invention. The configuration of the 5-grid optics system having a negative focus grid and shown in results 1200 is described below:

| | | |
|---|---|---|
| Perveance of Beamlet ((10$^{-9}$ Amps/Volt$^{3/2}$) | = | 4.9 |
| Beam current of beamlet (A) | = | 17.1 |
| Ion Energy (eV) | = | 250 eV |
| Ion Type | = | Argon |
| Charge | = | +1 |

-continued

| Grid | Electrical Potential (volts) | Aperture Diameter (mm) | Grid Thickness (mm) | Spacing from Previous (Upstream) Grid (mm) |
|---|---|---|---|---|
| Extraction Grid | 250 | 1.7 | 0.7 | N/A |
| Acceleration Grid (1024) | −100 | 1.6 | 0.9 | 2 |
| Shield Grid 1 | 0 | 1.5 | 0.7 | 0.9 |
| Focus Grid | −450 | 1.4 | 0.9 | 0.9 |
| Shield Grid 2 | 0 | 1.2 | 0.5 | 0.9 |

This configuration results in a calculated divergence angle of 0.9 degrees. Best results have been simulated when the magnitude of the focus grid potential is about 1 to 3 times the total extraction potential.

FIG. 12B illustrates simulated potential variations along an axis of the optics system of FIG. 12A. The graph 1250 includes a distance axis and a potential axis. The distance axis represents the distance from the most upstream surface of the extraction grid to the most downstream surface of the shield grid in an optics system. The potential axis represents the potential existing along the axis through the center of the apertures of an optics system.

Figure 13A:
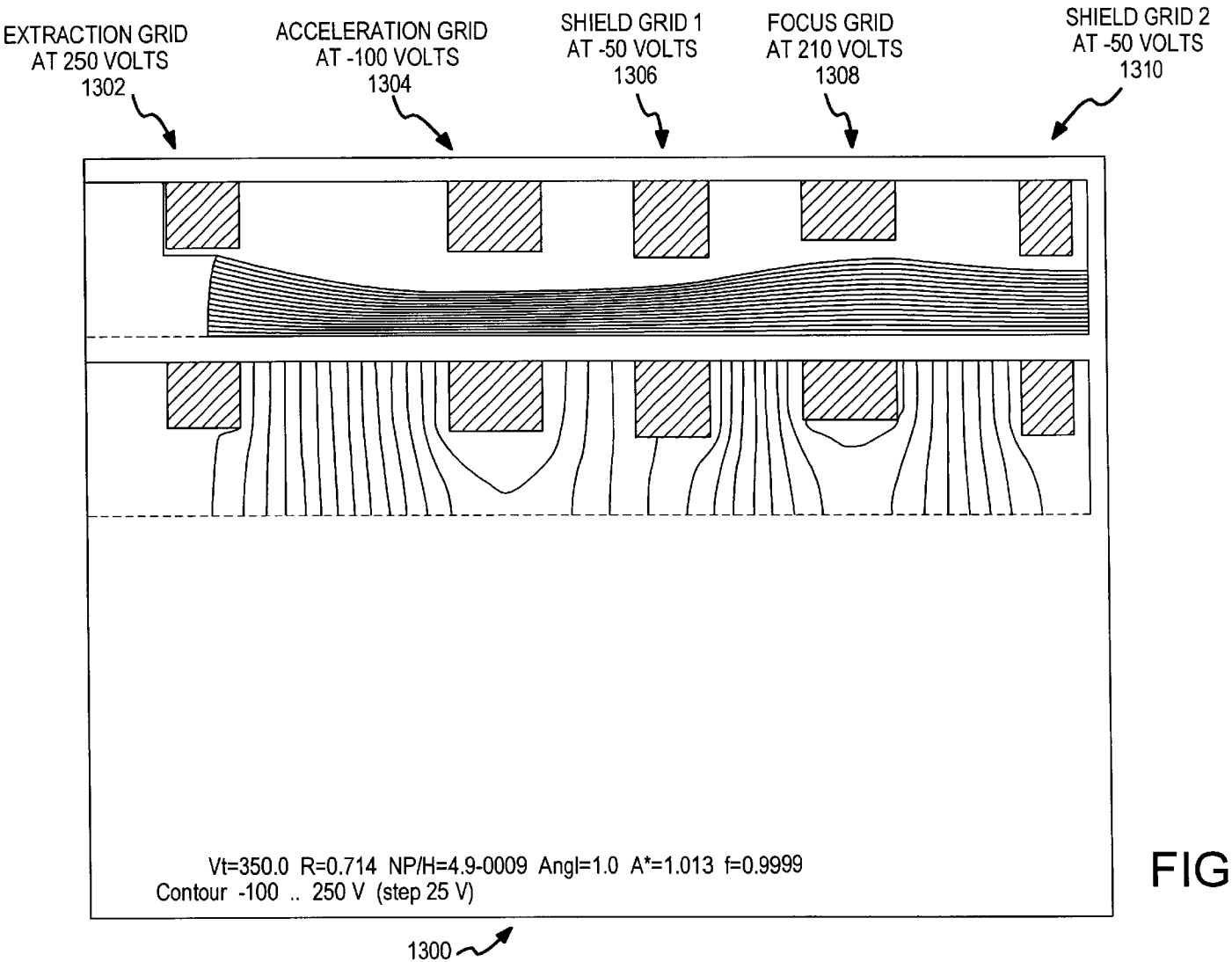
FIGS. 13A and 13B illustrate simulation results of another 5-grid ion beam source in an embodiment of the present invention.

FIG. 13A illustrates simulation results of another 5-grid ion beam source in an embodiment of the present invention. The configuration of the 5-grid optics system having a positive focus grid and shown in results 1300 is described below:

| | | |
|---|---|---|
| Perveance of Beamlet (10$^{-9}$ Amps/Volt$^{3/2}$) | = | 4.9 |
| Beam current of beamlet (A) | = | 17.1 |
| Ion Energy (eV) | = | 250 eV |
| Ion Type | = | Argon |
| Charge | = | +1 |

| Grid | Electrical Potential (volts) | Aperture Diameter (mm) | Grid Thickness (mm) | Spacing from Previous (Upstream) Grid (mm) |
|---|---|---|---|---|
| Extraction Grid | 250 | 1.7 | 0.7 | N/A |
| Acceleration Grid | −100 | 1.6 | 0.9 | 2 |
| Shield Grid 1 | −50 | 1.5 | 0.7 | 0.9 |
| Focus Grid | 210 | 0.9 | 0.9 | 0.9 |
| Shield Grid 2 | −50 | 0.5 | 0.5 | 1.1 |

This configuration results in a calculated divergence angle of 1.0 degree. Best results have been simulated when the focus grid potential is about 50% to 90% of the total extraction potential.

Figure 13B:
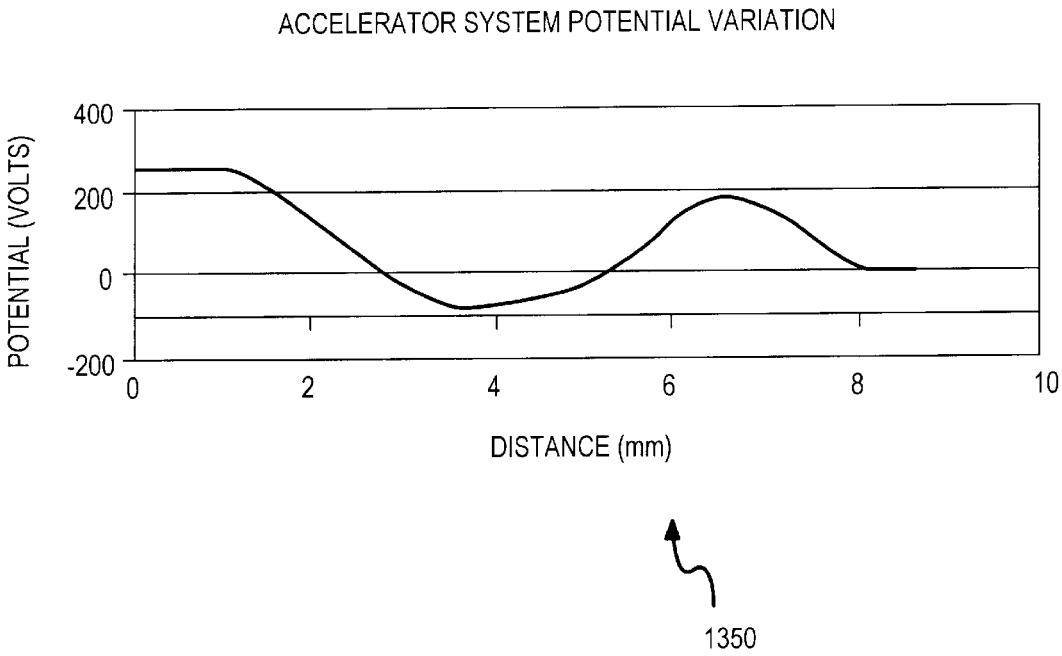

FIG. 13B illustrates simulated potential variations along an axis of the optics system of FIG. 13A. The graph 1350 includes a distance axis and a potential axis. The distance axis represents the distance from the most upstream surface of the extraction grid to the most downstream surface of the shield grid in an optics system. The potential axis represents the potential existing along the axis through the center of the apertures of an optics system.

As with the 4-grid systems described herein, the 5-grid systems are tuned by altering the focus grid potential until the detected angle of divergence is minimized. It should also be understood that, with both 4-grid and 5-grid systems, it is possible to predefine the focus grid potential based on simulation or experimental results and thereafter merely set the focus grid to the predetermined focus grid potential during each ion beam operation. In other words, it is not necessary to dynamically tune the focus grid at each use of the ion beam.

The embodiments of the invention described herein are implemented as logical operations in one or more computer systems. The logical operations of the present invention are implemented (1) as a sequence of processor-implemented steps executing in one or more computer systems and (2) as interconnected machine modules within one or more computer systems. The implementation is a matter of choice, dependent on the performance requirements of the computer system implementing the invention. Accordingly, the logical operations making up the embodiments of the invention described herein are referred to variously as operations, steps, objects, or modules.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A grid optics system for extracting ions from a plasma source and propelling the ions toward a target in a substantially collimated ion beam directed along an axis extending between the plasma source and the target, the grid optics system comprising:

an extraction grid spaced downstream from the plasma source along the axis and substantially normal to the axis, the extraction grid having a positive electrical extraction potential;

an acceleration grid spaced downstream from the extraction grid along the axis between the extraction grid and the target and substantially normal to the axis, the acceleration grid having a non-positive electrical acceleration potential, the electrical extraction potential and the electrical acceleration potential operating in combination to extract the ions from the plasma source;

a focus grid spaced downstream from the acceleration grid along and substantially normal to the axis between the acceleration grid and the target to focus the ions exiting the acceleration grid into a substantially collimated ion beam along the axis; and a shield grid spaced downstream from the focus grid along and substantially normal to the axis between the focus grid and the target to locate a neutralization plane near the shield grid.

2. The grid optics system of claim 1 wherein each of the extraction grid, the acceleration grid, the shield grid, and the focus grid is planar.

3. The grid optics system of claim 1 wherein the focus grid has a negative electrical focus potential.

4. The grid optics system of claim 3 wherein the negative electrical focus potential has a magnitude substantially within the range of two to three times the difference between the electrical extraction potential and the electrical acceleration potential.

5. The grid optics system of claim 1 wherein the focus grid has a positive electrical focus potential.

6. The grid optics system of claim 5 wherein the positive electrical focus potential has a magnitude substantially within the range of 50% to 90% of the difference between the electrical extraction potential and the electrical acceleration potential.

7. The grid optics system of claim 5 wherein the shield grid has a negative electrical shield potential.

8. The grid optics system of claim 1 wherein the focus grid has a tuned grid potential such that an angle of divergence of the substantially collimated ion beam is minimized.

9. The grid optics system of claim 8 wherein the shield grid has an electrical shield potential and the tuned grid potential is determined by fixing the electrical extraction potential, the electrical acceleration potential and the shield potential and by altering the tuned grid potential until the angle of divergence of the substantially collimated ion beam is minimized.

10. The grid optics system of claim 1 wherein the shield grid is a first shield grid and further comprising:

a second shield grid spaced between the acceleration grid and the focus grid.

11. The grid optics system of claim 10 wherein the focus grid has a tuned grid potential such that an angle of divergence of the substantially collimated ion beam is minimized.

12. The grid optics system of claim 11 wherein first shield grid has a first electrical shield potential, the second shield grid has a second electrical shield potential, and the tuned grid potential is determined by fixing the electrical extraction potential, the electrical acceleration potential, the first shield potential and the second shield potential and by altering the tuned grid potential until the angle of divergence of the substantially collimated ion beam is minimized.

13. A method of tuning a focus grid potential in an ion beam source, the ion beam source being capable of generating a substantially collimated ion beam that sends ions toward a target along an axis extending between a plasma source and the target, the method comprising:

providing an extraction grid spaced downstream from the plasma source along the axis and substantially normal to the axis, the extraction grid having a positive electrical extraction potential;

providing an acceleration grid spaced downstream from the extraction grid along the axis between the extraction grid and the target and substantially normal to the axis, the acceleration grid having a non-positive electrical acceleration potential;

providing a focus grid spaced downstream from the acceleration grid along and substantially normal to the axis between the acceleration grid and the target to focus the ions exiting the acceleration grid into a substantially collimated ion beam along the axis, the focus grid having an electrical focus potential;

providing a shield grid spaced downstream from the focus grid along and substantially normal to the axis between the focus grid and the target; the shield grid having an electrical shield potential;

detecting an angle of divergence of the ion beam; and altering the electrical focus potential until the detected angle of divergence of the ion beam is minimized.

14. The method of claim 13 wherein the shield grid is a first shield grid having a first electrical shield potential and further comprising:

providing a second shield grid between the acceleration grid and the focus grid along and substantially normal to the axis between the focus grid and the target; the second shield grid having a second electrical shield potential.

15. An ion beam source for generating a substantially collimated ion beam sending ions toward a target along an axis extending between a plasma source and the target, the ion beam source comprising:

an extraction grid spaced downstream from the plasma source along the axis and substantially normal to the axis, the extraction grid having a positive electrical extraction potential;

an acceleration grid spaced downstream from the extraction grid along the axis between the extraction grid and the target and substantially normal to the axis, the acceleration grid having a non-positive electrical acceleration potential, the electrical extraction potential and the electrical acceleration potential operating in combination to extract the ions from the plasma source;

a focus grid spaced downstream from the acceleration grid along and substantially normal to the axis between the acceleration grid and the target to focus the ions exiting the acceleration grid by changing momentum of the ions along the axis; and a shield grid spaced downstream from the focus grid along and substantially normal to the axis between the focus grid and the target to locate a neutralization plane near the shield grid.

16. The ion beam source of claim 15 wherein each of the extraction grid, the acceleration grid, the shield grid, and the focus grid is planar.

17. The ion beam source of claim 15 wherein the focus grid has a negative electrical focus potential.

18. The ion beam source of claim 17 wherein the negative electrical focus potential has a magnitude substantially within the range of two to three times the difference between the electrical extraction potential and the electrical acceleration potential.

19. The ion beam source of claim 15 wherein the focus grid has a positive electrical focus potential.

20. The ion beam source of claim 19 wherein the positive electrical focus potential has a magnitude substantially within the range of 50% to 90% of the difference between the electrical extraction potential and the electrical acceleration potential.

21. The ion beam source of claim 19 wherein the shield grid has a negative electrical shield potential.

22. The ion beam source of claim 15 wherein the focus grid has a tuned grid potential such that an angle of divergence of the substantially collimated ion beam is minimized.

23. The ion beam source of claim 22 wherein the shield grid has an electrical shield potential and the tuned grid potential is determined by fixing the electrical extraction potential, the electrical acceleration potential and the shield potential and by altering the tuned grid potential until the angle of divergence of the substantially collimated ion beam is minimized.

24. The ion beam source of claim 15 wherein the shield grid is a first shield grid and further comprising:

a second shield grid spaced between the acceleration grid and the focus grid.

25. The ion beam source of claim 24 wherein the focus grid has a tuned grid potential such that an angle of divergence of the substantially collimated ion beam is minimized.

26. The ion beam source of claim 25 wherein first shield grid has a first electrical shield potential, the second shield grid has a second electrical shield potential, and the tuned grid potential is determined by fixing the electrical extraction potential, the electrical acceleration potential, the first shield potential and the second shield potential and by altering the tuned grid potential until the angle of divergence of the substantially collimated ion beam is minimized.

27. A method of generating a substantially collimated ion beam sending ions toward a target along an axis extending between a plasma source and the target, the method comprising:

applying a positive electrical extraction potential to an extraction grid spaced downstream from the plasma source along the axis and substantially normal to the axis;

applying a non-positive electrical extraction potential to an acceleration grid spaced downstream from the extraction grid along the axis between the extraction grid and the target and substantially normal to the axis, the electrical extraction potential and the electrical acceleration potential operating in combination to extract the ions from the plasma source;

applying an electrical focus potential to a focus grid spaced downstream from the acceleration grid along and substantially normal to the axis between the acceleration grid and the target to focus the ions exiting the acceleration grid by changing momentum of the ions along the axis; and applying an electrical shield potential to a shield grid spaced downstream from the focus grid along and substantially normal to the axis between the focus grid and the target to locate a neutralization plane near the shield grid.

28. The method of claim 27 wherein each of the extraction grid, the acceleration grid, the shield grid, and the focus grid is planar.

29. The method of claim 27 wherein the operation of applying an electrical focus potential comprises:

applying a negative electrical focus potential to the focus grid.

30. The method of claim 29 wherein the negative electrical focus potential has a magnitude substantially within the range of two to three times the difference between the electrical extraction potential and the electrical acceleration potential.

31. The method of claim 27 wherein the operation of applying an electrical focus potential comprises:

applying a positive electrical focus potential to the focus grid.

32. The method of claim 31 wherein the positive electrical focus potential has a magnitude substantially within the range of 50% to 90% of the difference between the electrical extraction potential and the electrical acceleration potential.

33. The method of claim 27 wherein the operation of applying an electrical shield potential comprises:

applying a negative electrical shield potential.

34. A grid optics system for extracting ions from a plasma source and propelling the ions toward a target in a substantially collimated ion beam directed along an axis extending between the plasma source and the target, the grid optics system comprising:

extracting means for extracting the ions from the plasma;

focusing means for focusing the ions exiting the extracting means by changing momentum of the ions along the axis, the focusing means being positioned between the extracting means and the target; and shielding means for locating a neutralization plane near the shielding means, the shielding means being positioned between the focusing means and the target.

35. The grid optics system of claim 34 wherein the shielding means is a first shielding means and further comprising:

a second shielding means positioned between the focusing means and the extracting means for shielding the extraction means from backstreaming electrons.

* * * * *

UNITED STATES PATENT AND TRADEMARK OFFICE

CERTIFICATE OF CORRECTION

PATENT NO. : 6,759,807 B2
APPLICATION NO. : 10/117004
DATED : July 6, 2004
INVENTOR(S) : Erik Karl Kristian Wahlin It is certified that error appears in the above-identified patent and that said Letters Patent is hereby corrected as shown below:

In FIG. 1B, please change the reference number “160” (identifying a box formed from dashed lines) to reference number --166.--

In FIG. 1B, please change the dashed line labeled “162” to --164.--

In FIG. 6, please change the dashed line labeled “322” to --622.--

In FIG. 8B, please change the reference number “860” (identifying a box formed from dashed lines) to reference number --866.--

In FIG. 8B, please change the dashed line labeled “862” to --864--.

In FIG. 13A, please change “NP/H=4.9-0009” to --NP/H=4.9E-0009.--

In the specification, at col. 5, lines 33-34, please change “...system 504 are...” to --...system 106 are...--

In the specification, at col. 5, line 50, please change “...target 160...” to --...target 166...--

In the specification, at col. 5, line 50, please change “...ion beam 162.” to --...ion beam 164.--

In the specification, at col. 8, lines 64-65, please change “...screen grid 506...” to --...extraction grid 506...--

In the specification, at col. 9, line 23, please change “...ion beam 502...” to --...ion beamlet 500...--

In the specification, at col. 10, line 4, please delete the extra space to change “...potential of -5 0 volts...” to --...potential of -50 volts...--

In the specification, at col. 11, line 30, please change “...target 860...” to --...target 866...--

In the specification, at col. 11, line 30, please change “...ion beam 862.” to --...ion beam 864.--

In claim 4, col. 15, line 51, please change “...the range...” to --...a range...--

UNITED STATES PATENT AND TRADEMARK OFFICE

CERTIFICATE OF CORRECTION

PATENT NO. : 6,759,807 B2
APPLICATION NO. : 10/117004
DATED : July 6, 2004
INVENTOR(S) : Erik Karl Kristian Wahlin It is certified that error appears in the above-identified patent and that said Letters Patent is hereby corrected as shown below:

In claim 6, col. 15, line 58, please change "...the range..." to --...a range...--

In claim 12, col. 16, line 13, please change "...wherein first shield..." to --...wherein the first shield...--

In claim 13, col. 16, lines 39-40, please change "...a substantially collimated ion beam..." to --...the substantially collimated ion beam...--

In claim 13, col. 16, line 44, please change the semicolon to a comma following the word "target."

In claim 14, col. 16, line 55, please change the semicolon to a comma following the word "target."

In claim 18, col. 17, line 21, please change "...the range..." to --...a range...--

In claim 20, col. 17, line 28, please change "...the range..." to --...a range...--

In claim 26, col. 17, line 50, please change "...wherein first shield..." to --wherein the first shield…--

In claim 27, col. 18, line 1, please change "...electrical extraction..." to --...electrical acceleration...--

In claim 30, col. 18, line 30, please change "...the range..." to --...a range...--

In claim 32, col. 18, lines 38-39, please change "...the range..." to --...a range...--

UNITED STATES PATENT AND TRADEMARK OFFICE

CERTIFICATE OF CORRECTION

PATENT NO. : 6,759,807 B2
APPLICATION NO. : 10/117004
DATED : July 6, 2004
INVENTOR(S) : Erik Karl Kristian Wahlin It is certified that error appears in the above-identified patent and that said Letters Patent is hereby corrected as shown below:

In claim 34, col. 18, line 49, please change "...from the plasma..." to --...from a plasma...--

Signed and Sealed this

Sixteenth Day of January, 2007

JON W. DUDAS
*Director of the United States Patent and Trademark Office*